US010468783B2

(12) United States Patent
Soodmand et al.

(10) Patent No.: US 10,468,783 B2
(45) Date of Patent: Nov. 5, 2019

(54) MICROSTRIP PATCH ANTENNA APERTURE COUPLED TO A FEED LINE, WITH CIRCULAR POLARIZATION

(71) Applicant: Drayson Technologies (Europe) Limited, Oxfordshire (GB)

(72) Inventors: Soheyl Soodmand, London (GB); Bruno Roberto Franciscatto, London (GB); Manuel Pinuela Rangel, London (GB)

( * ) Notice: Subject to any disclaimer, the term of this patent is extended or adjusted under 35 U.S.C. 154(b) by 0 days.

(21) Appl. No.: 15/748,729

(22) PCT Filed: Jul. 27, 2016

(86) PCT No.: PCT/EP2016/067893
§ 371 (c)(1),
(2) Date: Jan. 30, 2018

(87) PCT Pub. No.: WO2017/017134
PCT Pub. Date: Feb. 2, 2017

(65) Prior Publication Data

US 2019/0013591 A1 Jan. 10, 2019

(30) Foreign Application Priority Data

Jul. 30, 2015 (GB) ..... 1513565.0
Sep. 3, 2015 (GB) ..... 1515664.9

(51) Int. Cl.
*H01Q 21/06* (2006.01)
*H01Q 9/04* (2006.01)
(Continued)

(52) U.S. Cl.
CPC ..... *H01Q 21/064* (2013.01); *H01Q 1/48* (2013.01); *H01Q 9/0428* (2013.01); *H01Q 9/0457* (2013.01); *H01Q 13/10* (2013.01)

(58) Field of Classification Search
CPC ..... H01Q 9/0428; H01Q 9/0457; H01Q 1/48; H01Q 21/064; H01Q 13/10
(Continued)

(56) References Cited

U.S. PATENT DOCUMENTS 4,208,660 A 6/1980 McOwen
5,539,420 A 7/1996 Dusseux et al.
(Continued)

FOREIGN PATENT DOCUMENTS

FR 2943185 A1 9/2010
JP H07226618 A 8/1995

OTHER PUBLICATIONS

Wu J-F et al: "Broadband circulatory-polarised microtstrip antenna with switchable polarisation sense"; Electronics Letters, IEE Stevenage vol. 42, No. 24, Nov. 23, 2006, pp. 1374-1375.
(Continued)

*Primary Examiner* — Lam T Mai
(74) *Attorney, Agent, or Firm* — Tarolli, Sundheim, Covell & Tummino LLP

(57) ABSTRACT

An antenna is disclosed. The antenna comprises a feedline (101), a ground plane (102) and a radiator (103). The feedline has a path in a first plane, the path having a first arm (1011) and a second arm (1012) perpendicular to the first arm. The ground plane is provided in a second plane spaced apart from, and parallel to, the first plane. The ground plane has a ground plane slot (1021) therein with a path in the second plane. The path of the ground plane slot intersects the path of the feedline at a first position on the first arm and a second position on the second arm when the second plane is projected into the first plane. The radiator is separated from the feedline by the ground plane, and is provided in a third plane spaced apart from, and parallel to, the second plane.

20 Claims, 40 Drawing Sheets

(51) Int. Cl.
*H01Q 1/48* (2006.01)
*H01Q 13/10* (2006.01)

(58) Field of Classification Search
USPC ..... 343/770, 700 MS, 893
See application file for complete search history.

(56) References Cited

U.S. PATENT DOCUMENTS

| | | | | |
|---|---|---|---|---|
| 6,002,369 | A * | 12/1999 | Richard | H01Q 1/242 343/700 MS |
| 6,636,179 | B1 | 10/2003 | Woo et al. | |
| 2002/0180655 | A1* | 12/2002 | Mohuchy | H01Q 13/085 343/770 |
| 2003/0137456 | A1* | 7/2003 | Sreenivas | H01Q 1/38 343/700 MS |
| 2005/0007286 | A1* | 1/2005 | Trott | H01Q 13/085 343/770 |
| 2005/0200545 | A1* | 9/2005 | Bancroft | H01Q 13/10 343/770 |
| 2006/0132359 | A1 | 6/2006 | Chang et al. | |
| 2007/0115193 | A1 | 5/2007 | Minard et al. | |
| 2008/0079644 | A1 | 4/2008 | Cheng | |
| 2008/0266178 | A1 | 10/2008 | Tiezzi et al. | |
| 2012/0268347 | A1* | 10/2012 | Tatarnikov | H01Q 9/0464 343/893 |
| 2018/0102594 | A1* | 4/2018 | Murdock | H01Q 1/2291 |

OTHER PUBLICATIONS

Su C-W et al: "Slot-coupled microstrip antenna for broadband circular polarisation"; Electronics Letters, IEE Stevenage vol. 42, No. 6, Mar. 16, 2006, pp. 318-319.

Row J-S: "Design of Aperture-Coupled Annular-Ring Microstrip Antennas for Circular Polarization"; IEEE Transactions on Antennas and Propagation, IEEE Service Center vol. 53, No. 5, May 1, 2005, pp. 1779-1784.

Murakami Y et al: "Slot-coupled self-diplexing array antenna for mobile satellite communications"; IEE Proceedings: Microwaves, Antennas and Propagation, IEE Stevenage vol. 143, No. 2, Apr. 18, 1996, pp. 119-123.

Kin-Lu Wong et al: "A compact dual-band dual-polarized patch antenna for 900-1800-MHz cellular systems"; IEEE Transactions on Antennas and Propagation, IEEE Service Center vol. 51, No. 8, Aug. 1, 2003, pp. 1936-1940.

Ching-Wei Ling et al: "Dual-band circularly polarized dielectric resonator antenna"; IEEE Antennas and Propagation Society International Symposium, 2003 Digest, vol. 3, pp. 496-499, Jun. 22, 2003.

Mariusz Pergol et al: "Broadband microstrip patch antenna with reduced transversal size"; 19th International Conference on Microwave Radar and Wireless Communications (MIKON), Jun. 14, 2010, pp. 1-3.

GB Search Report dated Feb. 18, 2016 for corresponding GB Application No. 1515664.9.

International Search Report and Written Opinion dated Sep. 27, 2016 for corresponding International Application No. PCT/EP2016/067893.

UK Search Report dated Apr. 9, 2019 for corresponding GB Application No. 1515664.9.

Hsieh et al., IEEE Transactions on Antennas and Propagation, vol. 60, No. 4, 2012, "Dual-band Circularly Polarized Cavity-Backed Annular Slot Antenna for GPS Receiver", pp. 2076-2080, DOI 10.1109/TAP.2012.2186229.

Heikkinen et al., IEEE Antennas and Wireless Propagation Letters, vol. 2, 2003, "Novel Dual-Frequency Circularly Polarized Rectenna", pp. 330-333, DOI 10.1109/LAWP.2004.824166.

Le Bolzer et al., 11th International Conference on Antennas and Propagation 2001, "Multi-band annular slot antenna for WLAN applications", DOI 10.1049Icp:20010343.

Heikkinen et al., IEEE Antennas and Propagation Society International Symposium 2008, "Directive dual-band CP shorted ring-slot antenna". DOI 10.1109/APS.2008.4618982.

Gani et al., IEEE International Workshop on Antenna Technology: Small Antennas and Novel Metamaterials, 2005, "Arbitrary Dual-Band Circularly Polarized Patch Antenna", DOI 10.1109/IWAT.2005.1461063.

Chen et al., Proceedings of APMC 2012, "Dual-Band Circularly Polarized Annular Ring Slot Antenna", DOI 10.1109/APMC.2012.6421493.

Farias et al., 8th European Conference on Antennas and Propagation 2014, "Dual-Band Annular Slot Antenna for Radio Base Stations", DOI 10.1109/EuCAP.2014.6902211.

* cited by examiner

MICROSTRIP PATCH ANTENNA APERTURE COUPLED TO A FEED LINE, WITH CIRCULAR POLARIZATION

TECHNICAL FIELD

The present invention relates generally to the field of antennas.

BACKGROUND

Antennas are used in many fields such as wireless energy harvesting, wireless energy transfer and telecommunications. Antennas enable the transmission and/or reception of energy or signals, depending upon the application. The following characteristics can be important for an antenna:

- high gain;
- good return loss;
- circular polarisation (this can be particularly important in reception mode as this provides an orientation-independent reception capability and allows the reception of more wireless energy compared with a linear polarisation antenna);
- a large antenna effective area (to increase the amount of RF energy transmitted or received);
- a small footprint
- preferably multiband transmission and/or reception capability (to allow RF energy to be transmitted and/or received in different frequency bands);
- preferably low production cost;
- preferably lightweight.

The present invention aims to provide an antenna with one or more of the above characteristics.

SUMMARY

The present invention provides an antenna. The antenna comprises a feedline, a ground plane and a radiator. The feedline has a path in a first plane, the path having a first arm and a second arm perpendicular to the first arm. The ground plane is provided in a second plane spaced apart from, and parallel to, the first plane. The ground plane has a ground plane slot therein with a path in the second plane. The path of the ground plane slot intersects the path of the feedline at a first position on the first arm and a second position on the second arm when the second plane is projected into the first plane. The radiator is separated from the feedline by the ground plane, and is provided in a third plane spaced apart from, and parallel to, the second plane.

The present invention also provides a device comprising an antenna as described above, wherein the radiator is printed or plated onto the case of the device.

BRIEF DESCRIPTION OF THE DRAWINGS

Embodiments of the invention will now be described with reference to the accompanying drawings, in which like reference numbers designate the same or corresponding parts and in which.

DETAILED DESCRIPTION OF EMBODIMENTS

First Embodiment

Figure 1A:
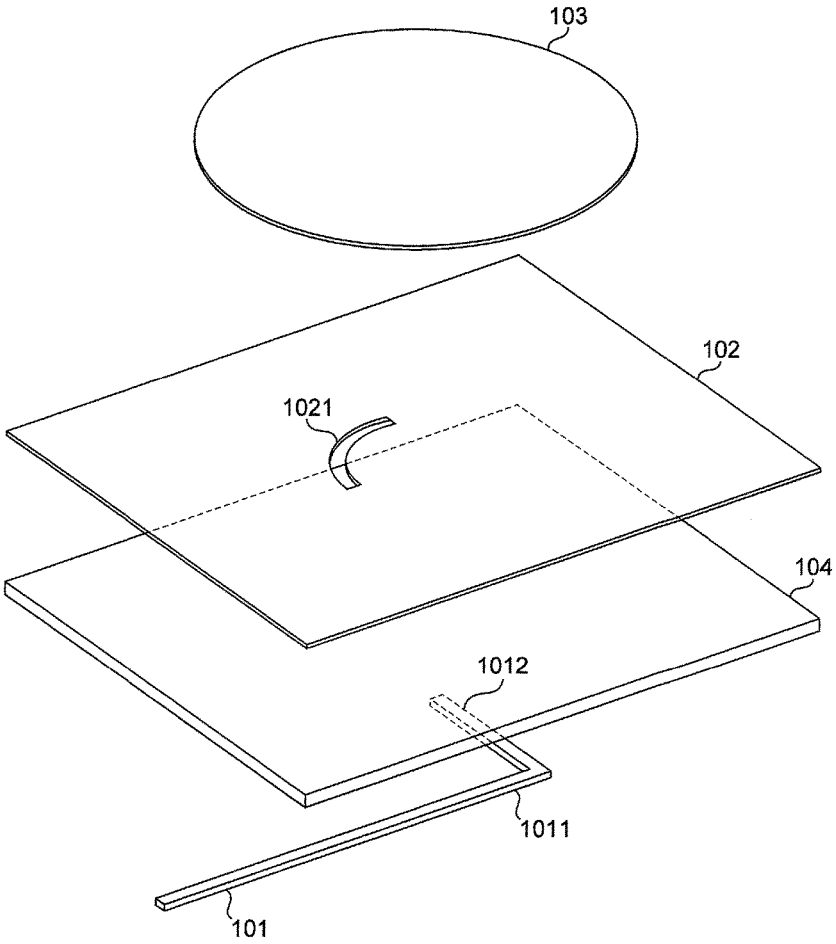
FIG. 1A shows an exploded view of an antenna according to a first embodiment of the present invention.
Figure 1B:
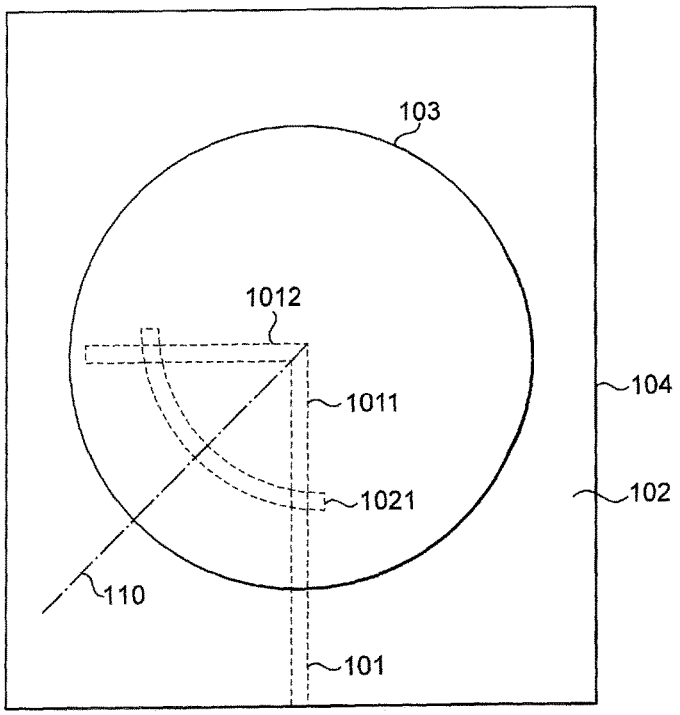
FIG. 1B shows a plan view of the antenna according to the first embodiment of the present invention.

A first embodiment of the present invention will be described with reference to FIGS. 1A and 1B, which schematically show the components of an antenna.

The antenna comprises a feedline 101, a ground plane 102 with a ground plane slot 1021 therein and a radiator 103. The feedline 101, ground plane 102 and radiator 103 are all formed from an electrically conductive material, such as copper. It will be understood that, when the antenna is used in an energy collecting mode, for example, during energy harvesting, the radiator 103 acts as a radiation collector.

In this embodiment, the feedline 101 and ground plane 102 are conveniently formed as layers on each side of a substrate 104. The substrate is made from a dielectric material and provides a suitable mechanical support to hold the feedline 101 in a first plane and the ground plane 102 in a second plane spaced apart from, and parallel to, the first plane. Here, it will be understood by the skilled person that parallel to does not mean that the angle between the plane of the feedline 101 and the plane of the ground plane 102 is strictly zero degrees but that variations in the angle up to ±2.5 degrees are encompassed, as such variations will not significantly degrade performance of the antenna. It will be further understood that the substrate is not an essential component and that any suitable mechanical structure can be provided to hold the feedline 101 and the ground plane 102 in their respective planes.

In this embodiment, feedline 101 is a 50 ohm line and is conveniently formed from a microstrip, but could also be formed using a stripline. The feedline 101 has a first arm 1011 acting as an input feed and a second arm 1012, perpendicular to the first arm, that acts as an output feed. Referring to FIG. 1B, the path of the ground plane slot 1021 intersects the path of the feedline 101 at a first position on the first arm 1011 and a second position on the second arm 1012 when the plane of the ground plane is projected into the plane of the feedline (or vice versa).

Here, as throughout the description and claims, a projection is the transformation of points and lines in one plane onto another plane by connecting corresponding points on the two planes with parallel lines perpendicular to the planes. This is equivalent to shining a point light source located at infinity through one of the planes to form an image of whatever is provided on the plane on the other plane.

Each intersection of the projected ground plane slot 1021 with the feedline 101 acts as a source of transverse electromagnetic radiation (TEM). Circular polarisation is achieved when one of the TEM sources is rotated by a right angle (90 degrees) to the other. Accordingly, the first and second arms 1011, 1012 of the feedline are perpendicular to each other. However, it will be understood by the skilled person that perpendicular does not mean that the angle between the first and second arms 1011, 1012 is strictly 90 degrees but that variations in the angle up to ±2.5 degrees are encompassed, as such variations will not significantly degrade performance of the antenna. In addition, to provide the circular polarisation, the ground plane slot 1021 is configured such that the distance between the two intersections of the projected ground plane slot 1021 with the feedline 101 (that is, the distance between the TEM sources) provides a 90 degrees phase shift for the waveband of radiation to be transmitted and/or received. Furthermore, in this embodiment, the ground plane slot 1021 is a circular arc, and the feedline 101 and the ground plane 102 are positioned relative to each other such that the centre of the circular arc of the ground plane slot 1021 is at the intersection of the first arm 1011 and the second arm 1012 when the plane of the ground plane 102 is projected into the plane of the feedline 101 (or vice versa). Also, referring to FIG. 1B, the ground plane slot 1021 in this embodiment is orientated such that the bisector 110 of the arc angle (the centre angle) of the ground plane slot 1021 also bisects the angle between the first and second arms 1011, 1012 when the plane of the ground plane 102 is projected into the plane of the feedline 101 (or vice versa).

The first embodiment is therefore a single feed antenna. The required two orthogonal resonant modes are possible through series feed.

Turning now to the radiator 103, this is separated from the feedline 101 by the ground plane 102. The radiator 103 is held in a third plane spaced apart from, and parallel to, the ground plane 102. Here, it will again be understood by the skilled person that parallel to does not mean that the angle between the plane of the radiator 103 and the plane of the ground plane 102 is strictly zero degrees but that variations in the angle up to ±2.5 degrees are encompassed, as such variations will not significantly degrade performance of the antenna. The space between the radiator 103 and the ground plane 102 is preferably an air gap, as the inventors have found this improves the return loss of the antenna.

In this embodiment, the radiator 103 is circular and is positioned relative to the feedline 101 such that the centre of the radiator 103 is at the intersection of the first arm 1011 and the second arm 1012 when the plane of the radiator 103 is projected into the plane of the feedline 101 (or vice versa).

Figure 2:
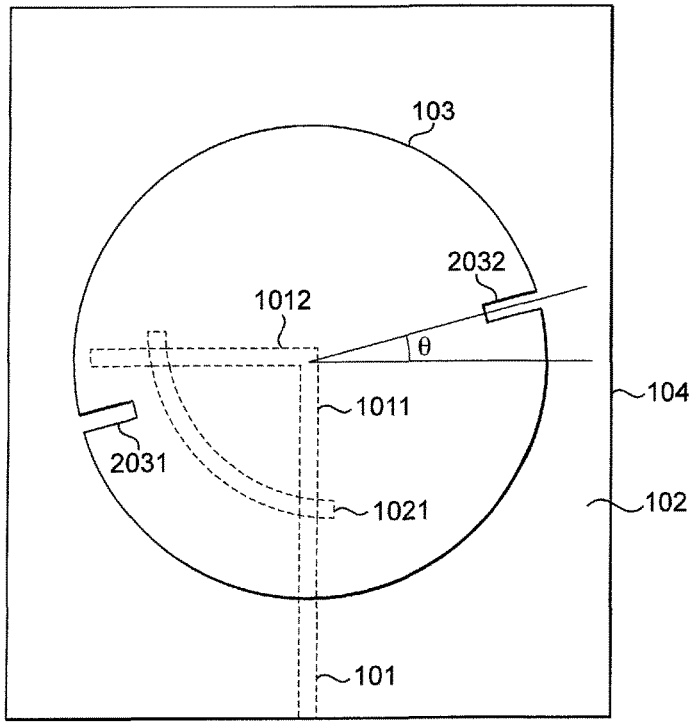
FIG. 2 shows a modification of the antenna of the first embodiment.

FIG. 2 shows a modification of the first embodiment, in which radiator 103 includes optional first 2031 and second 2032 radiator slots, the first 2031 and second 2032 radiator slots being on a diameter of the radiator 103 on opposite sides of the centre and at the edge of the radiator 103.

The diameter on which the first and second radiator slots 2031, 2032 lie forms an angle θ relative to the path of the outgoing feed 1012 when the plane of the ground plane 102 is projected into the plane of the feedline 101 (or vice versa).

This modification has been found by the inventors to have the effect of further amplifying the circular polarization characteristics of the antenna.

Second Embodiment

Figure 3A:
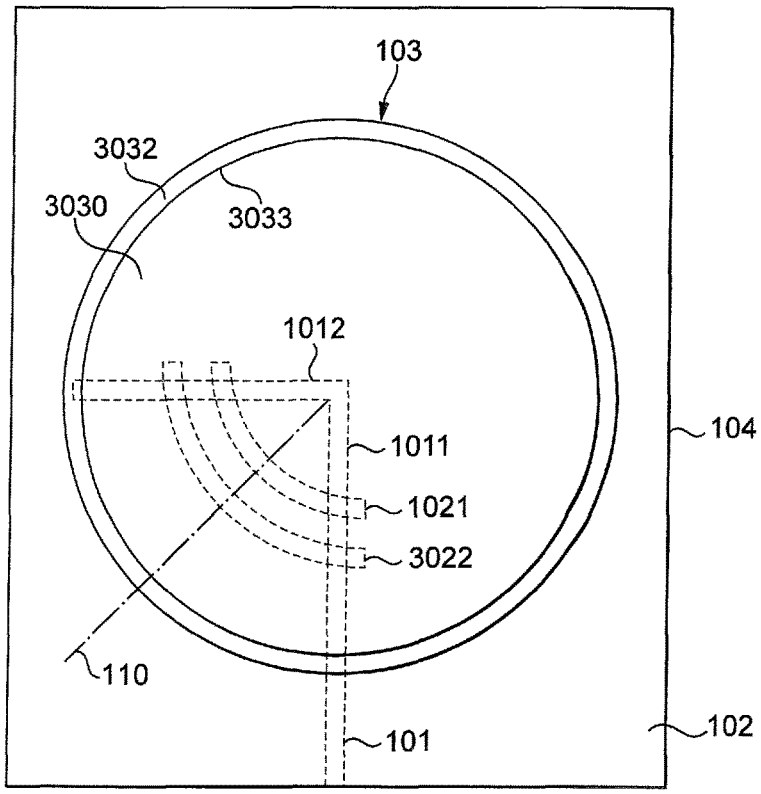
FIG. 3A shows an antenna according to a second embodiment of the present invention.

FIG. 3A shows a second embodiment of the present invention with dual band transmission and/or reception capability.

The second embodiment comprises a feedline 101, ground plane 102 and radiator 103, as in the first embodiment. However, to provide dual band transmission and/or reception capability, a second ground plane slot 3022 is provided in addition to the first ground plane slot 1021. Furthermore, the radiator 103 comprises a circular inner section 3030 and an outer section 3032 formed of an outer ring, the inner section 3030 and outer section 3032 being electrically separated by a separating ring 3033. In this embodiment, radiator 103 is formed as one continuous circle of copper (or other conductive material) and then the inner and outer sections 3030, 3032 are formed by removing a ring of copper (or other conductive material) to form the separating ring 3033. However, the inner and outer sections 3030, 3032 could be formed separately, and they could have a separating ring of insulating material therebetween.

The second embodiment provides dual band signal or energy transmission and/or reception capability. By way of non-limiting example, such an antenna could be used to transmit and/or receive signals (or energy) in the waveband of Wi-Fi (operating around 2.4 GHz) and, at the same time, the waveband of GSM (operating around 1.8 GHz—referred to as GSM 1800).

The path of the first ground plane slot 1021 intersects the path of the feedline 101 at a first position on the first arm 1011 and a second position on the second arm 1012 when the plane of the ground plane 102 is projected into the plane of the feedline 101 (or vice versa). The path of the second ground plane slot 3022 intersects the path of the feedline 101 at a third position on the first arm 1011 and a fourth position on the second arm 1012 when the plane of the ground plane 102 is projected into the plane of the feedline 101 (vice versa).

The second ground plane slot 3022 is configured such that the distance between the two intersections of the projected ground plane slot 3022 with the feedline provides a 90 degrees phase shift for the waveband of radiation in the second waveband to be transmitted and/or received. Furthermore, in this embodiment, the first and second ground plane slots 1021, 3022 are both circular arcs with the same centre. The feedline 101 and the ground plane 102 are positioned relative to each other such that the centre of the circular arcs of the ground plane slots 1021, 3022 is at the intersection of the first arm 1011 and the second arm 1012 when the plane of the ground plane 102 is projected into the plane of the feedline 101 (or vice versa). Also, both of the ground plane slots 1021, 3022 in this embodiment are orientated such that the bisector 110 of the arc angle (the centre angle) of the first ground plane slot 1021 is also a bisector of the arc angle of the second ground plane slot 3022, and furthermore bisects the angle between the first and second arms 1011, 1021 when the plane of the ground plane 102 is projected into the plane of the feedline 101 (or vice versa).

Figure 3B:
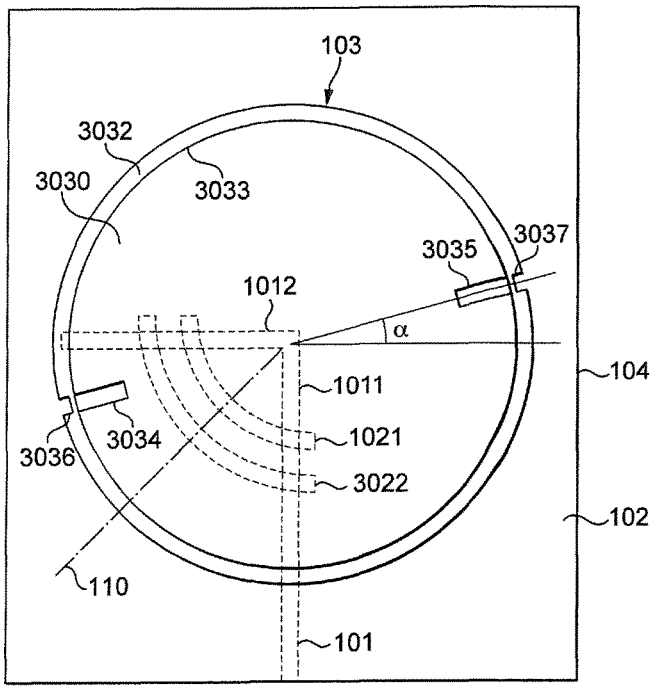
FIG. 3B shows a modification of the antenna of the second embodiment.

FIG. 3B shows a modification of the second embodiment, in which the inner section 3030 of radiator 103 optionally includes a first inner radiator slot 3034 and a second inner radiator slot 3035, the first 3034 and second 3035 inner radiator slots lying on a diameter of the inner section 3030 of the radiator 103 on opposite sides of the centre and at the edge of the inner section 3030.

Moreover, as shown in FIG. 3B, the outer section 3032 of the radiator 103 may optionally include a first outer radiator slot 3036 and a second outer radiator slot 3037, the first 3036 and second 3037 outer radiator slots lying on a diameter of the radiator 103 on opposite sides of the centre and at the outer edge of the outer section 3032.

The diameter on which the inner radiator slots 3034, 3035 lie is preferably the same diameter as that on which the outer radiator slots 3036, 3037 lie. The diameter on which the inner radiator slots 3034, 3035, and the outer radiator slots 3036, 3037 lie forms an angle α relative to the path of the outgoing feed 1012 when the plane of the ground plane 102 is projected into the plane of the feedline 101 (or vice versa).

This modification has been found by the inventors to have the effect of further amplifying the circular polarization characteristics of the antenna.

The present inventors performed experiments to determine parameters of the antenna shown in FIG. 3B that affect its performance.

Figure 4A:
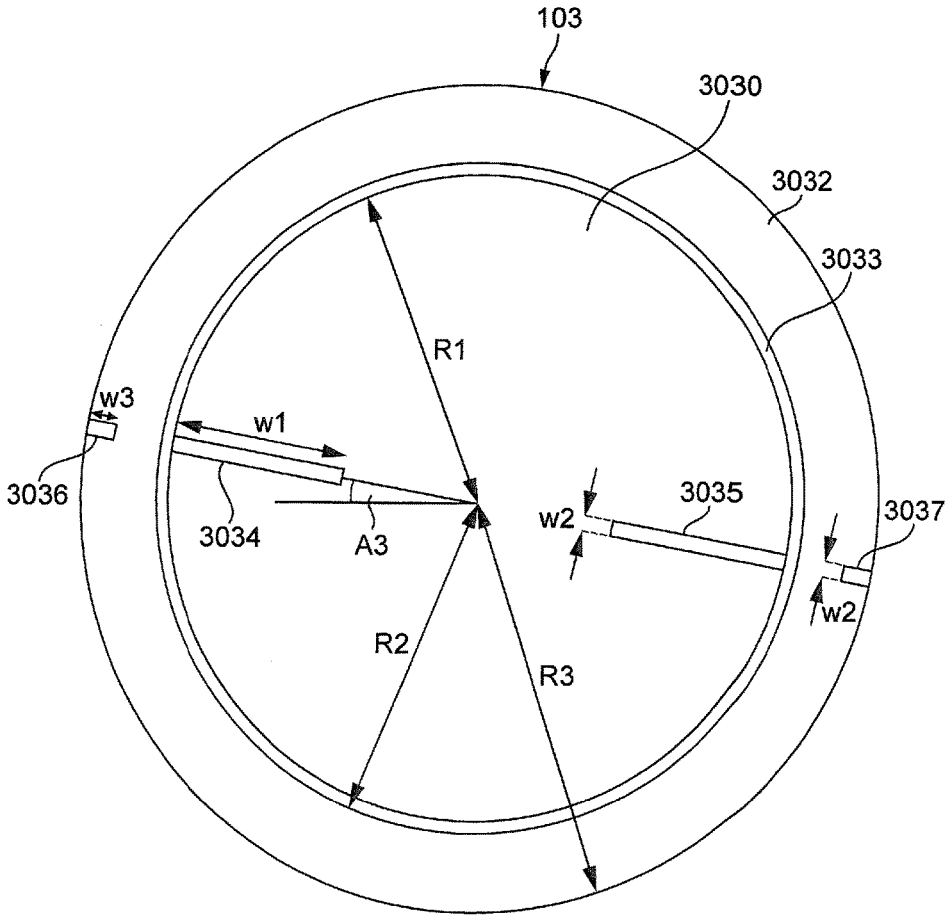
FIG. 4A shows a view of a radiator of an antenna used in simulations.
Figure 4B:
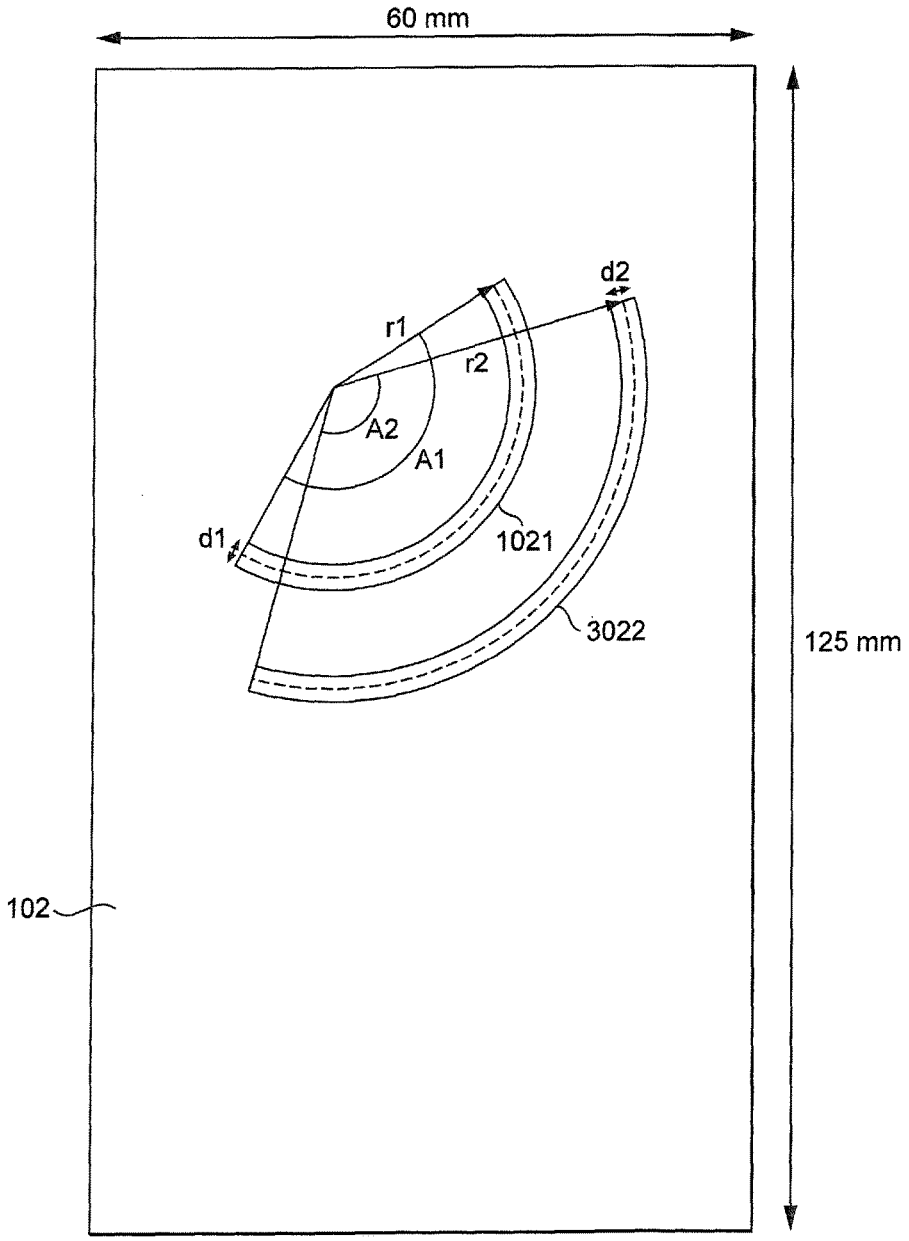
FIG. 4B shows a view of a ground plane of the antenna used in simulations.
Figure 4C:
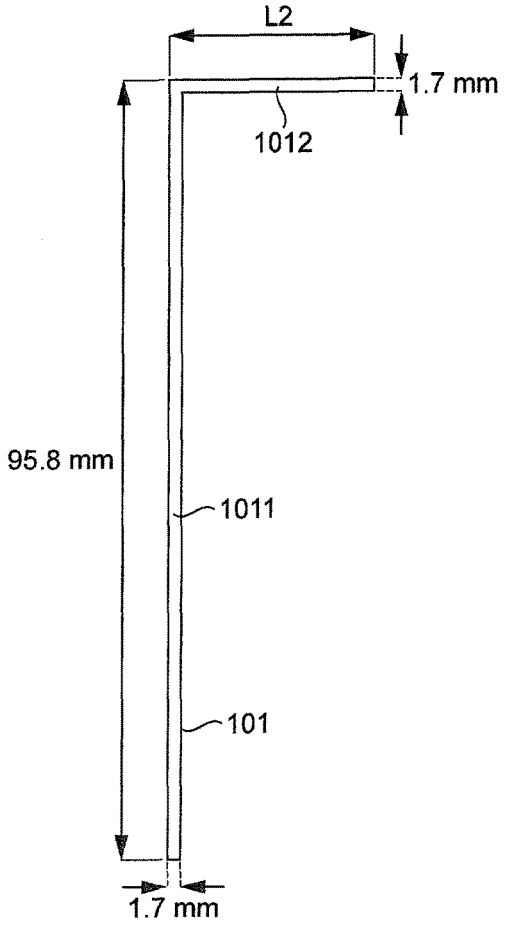
FIG. 4C shows a view of a feedline of the antenna used in simulations.

Referring to FIGS. 4A to 4C, the experiments performed by the inventors revealed that the following parameters affect the antenna performance:

d1: the width of the first ground plane slot 1021;

d2: the width of the second ground plane slot 3022;

r1: the radius of the first ground plane slot 1021 to the centre of the slot;

r2: the radius of the second ground plane slot 3022 to the centre of the slot;

A1: the arc angle (centre angle) of the first ground plane slot 1021;

A2: the arc angle (centre angle) of the second ground plane slot 3022;

R1: the radius from the centre of the inner section 3030 of the radiator 103 to the outer edge of the inner section 3030;

R2: the distance from the centre of the inner section 3030 of the radiator 103 to the inside edge of the outer ring of the outer section 3032 of the radiator 103;

R3: the distance from the centre of the inner section 3030 of the radiator 103 to the outside edge of the outer ring of the outer section 3032;

R2−R1: the width of the separating ring 3033;

w1: the length of each of the first 3034 and second 3035 inner radiator slots;

w2: the width of the first 3034 and second 3035 inner radiator slots and/or the first 3036 and second 3037 outer radiator slots;

w3: the length of each of the first 3036 and second 3037 outer radiator slots;

L2: the length of the outgoing feed 1012 of the feedline 101; and

A3: the angle between the diameter on which the first and second inner radiator slots 3034, 3035 and the first and second outer radiator slots 3036, 3037 lie and the path of the outgoing feed when the plane of the ground plane 102 is projected into the plane of the feedline 101 (or vice versa).

The present inventors performed simulations to determine a range of values for each respective parameter above that would provide acceptable performance of the antenna. For the purposes of the simulations, the substrate material was modelled with a thickness 0.76 mm and with the electrical characteristics of a low-loss laminate material, such as IS680-345 available commercially from ISOLA Group s.a.r.l.

In the field of antenna design, antennas are performance-rated using S-parameters which describe the input-output relationship of energy or power between ports or terminals of the antenna. One of the most commonly used performance ratings for antennas is the S11 parameter. The S11 parameter is known as the input port voltage reflection coefficient and represents how much power is reflected from the antenna for a given incident power. If Vinc is the voltage amplitude of the incident signal and Vref is the voltage amplitude of the reflected signal then S11=Vref/Vinc. The power reflection coefficient can then be expressed on a decibel (dB) scale as $$S11\ (\text{dB}) = -20 \cdot \log(S11)$$

For example if S11=0 dB, then all the power is reflected from the antenna and nothing is radiated, or if S11=−10 dB and 3 dB of power is delivered to the antenna then the reflected power is −7 dB.

Acceptable antenna performance, as recognised by antenna engineers, is achieved for a reflection coefficient (S11) with a magnitude of at least 10 dB.

Accordingly, in the simulations, acceptable antenna performance was taken as having an S11 magnitude of at least 10 dB in at least one of the frequency ranges GSM1800 (1.85 to 1.88 GHz) and Wi-Fi (2.4 to 2.495 GHz). The simulations were performed using an antenna comprising three layers, in which the first layer relates to the radiator 103, as shown FIG. 4A, the second layer relates to the ground plane 102 as shown in FIG. 4B, and the third layer relates to the antenna feedline 101 as shown in FIG. 4C. In FIGS. 4A, 4B and 4C, the views are plan views looking through the layers as they would be assembled in a device.

Referring to FIG. 4B, the ground plane 102 was modelled with width 60 mm and length 125 mm. Referring to FIG. 4C, the feedline 101 was modelled with a width of 1.7 mm. The length L1 of the incoming feed of the feedline 101 was modelled as 95.8 mm.

The copper thickness was modelled as 35 microns.

The gap between the ground plane 102 and the radiator 103 was modelled as 5 mm.

The simulations of the antenna were performed using CST Microwave®.

The simulation results for each of these parameters will now be described. For each parameter, the simulation results comprise a S11 (dB) graph and a corresponding Smith Chart, which includes a superimposed Voltage Standing Wave Ratio (VSWR) circle with value 2:1 representing an S11 magnitude of 9.54 dB normalised for Z0=50 ohms.

Figure 5A:
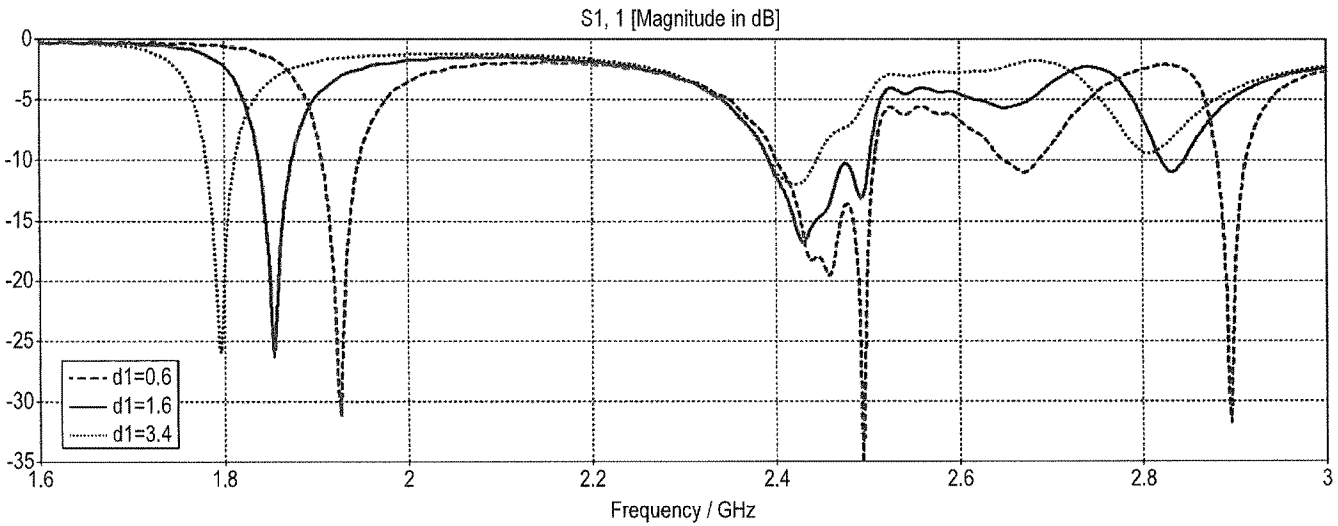
FIG. 5A comprises simulation results showing how the magnitude of the S-parameter S11 varies with frequency for changes in the width of the first ground plane slot in the antenna.
Figure 5B:
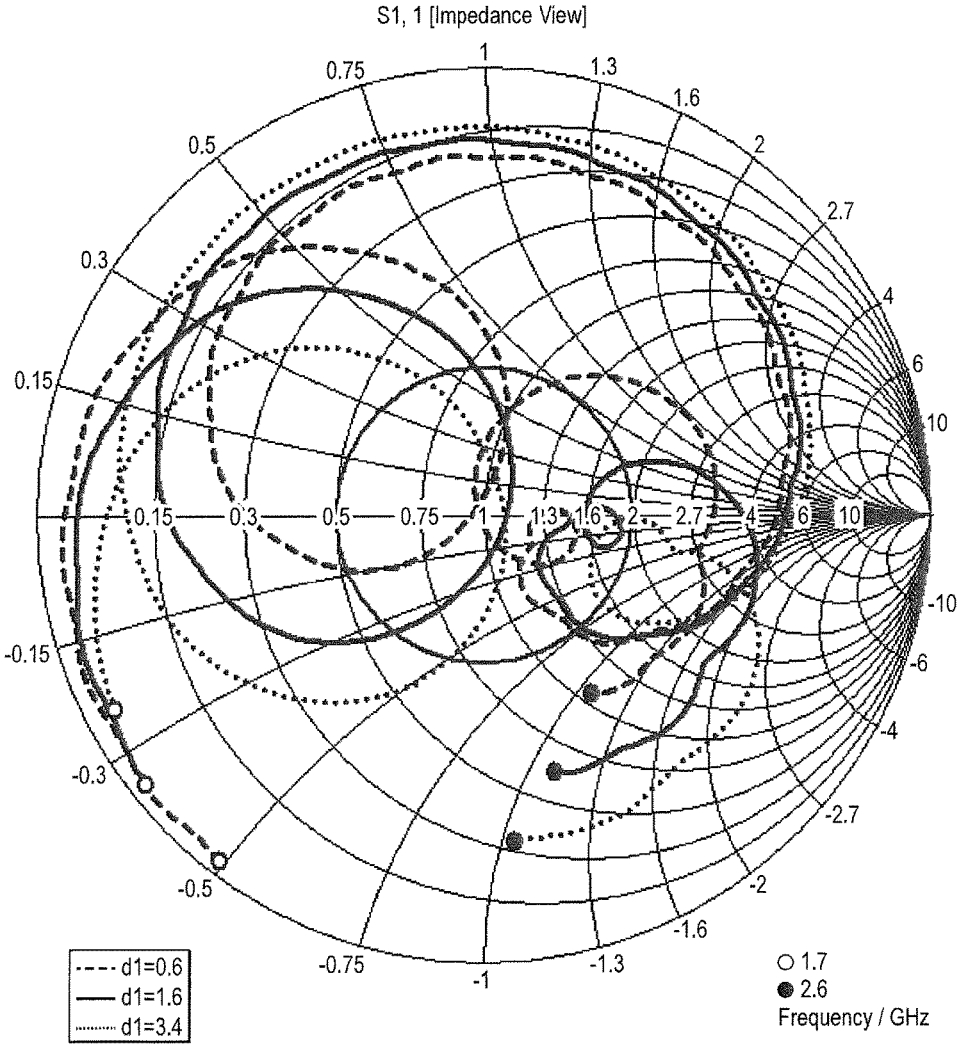
FIG. 5B comprises simulation results showing a Smith Chart of the variation in the S-parameter S11 with frequency for changes in the width of the first ground plane slot in the antenna.

FIGS. 5A and 5B show the simulation results for the parameter d1, namely the width of the first ground plane slot 1021. The simulation results show variations in S11 over the relevant frequency range for various values of the parameter d1. Referring to FIG. 5A, the simulation results demonstrate that acceptable performance is achieved when d1 is between 0.6 mm and 3.4 mm.

Figure 6A:
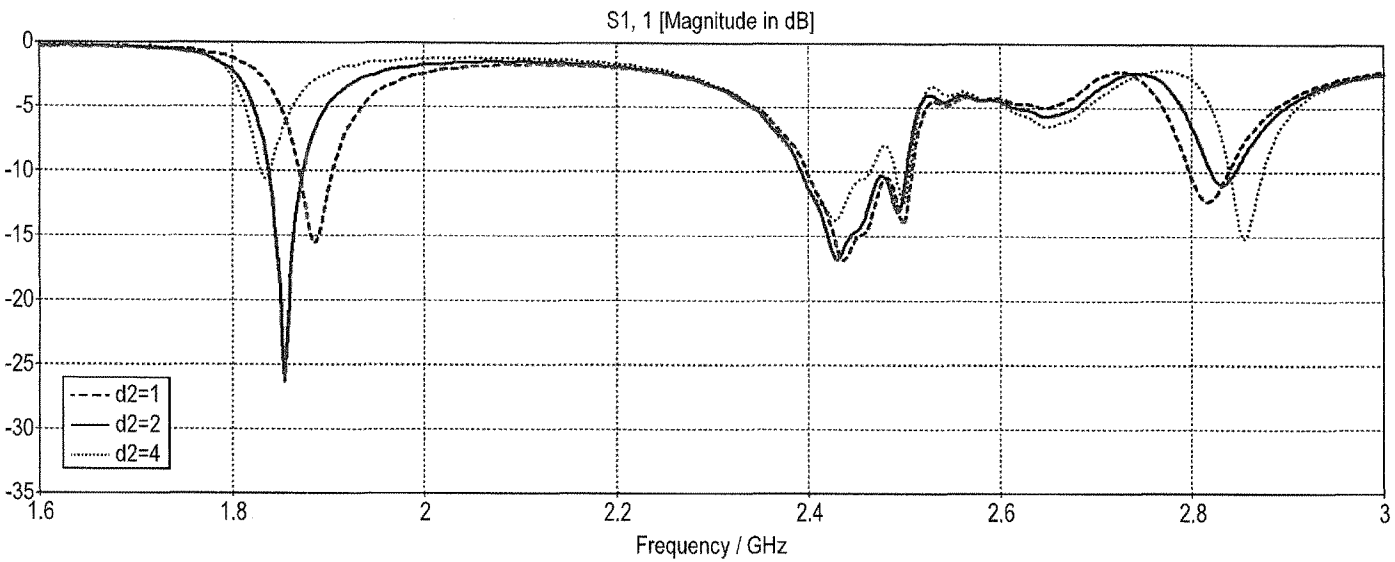
FIG. 6A comprises simulation results showing how the magnitude of the S-parameter S11 varies with frequency for changes in the width of the second ground plane slot in the antenna.
Figure 6B:
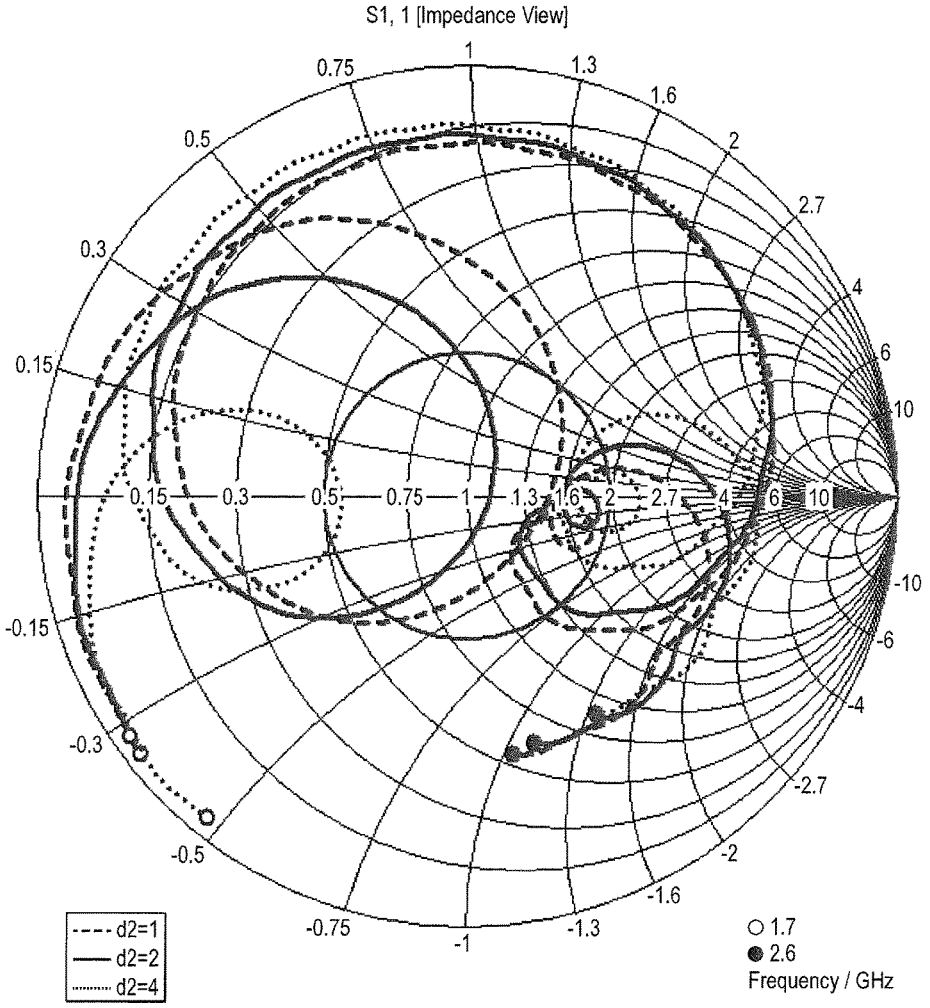
FIG. 6B comprises simulation results showing a Smith Chart of the variation in the S-parameter S11 with frequency for changes in the width of the second ground plane slot in the antenna.

FIGS. 6A and 6B show the simulation results for the parameter d2, namely the width of the second ground plane slot 3022. The simulation results show variations in S11 over the relevant frequency range for various values of the parameter d2. Referring to FIG. 6A, the simulation results demonstrate that acceptable performance is achieved when d2 is between 1 mm and 4 mm.

Figure 7A:
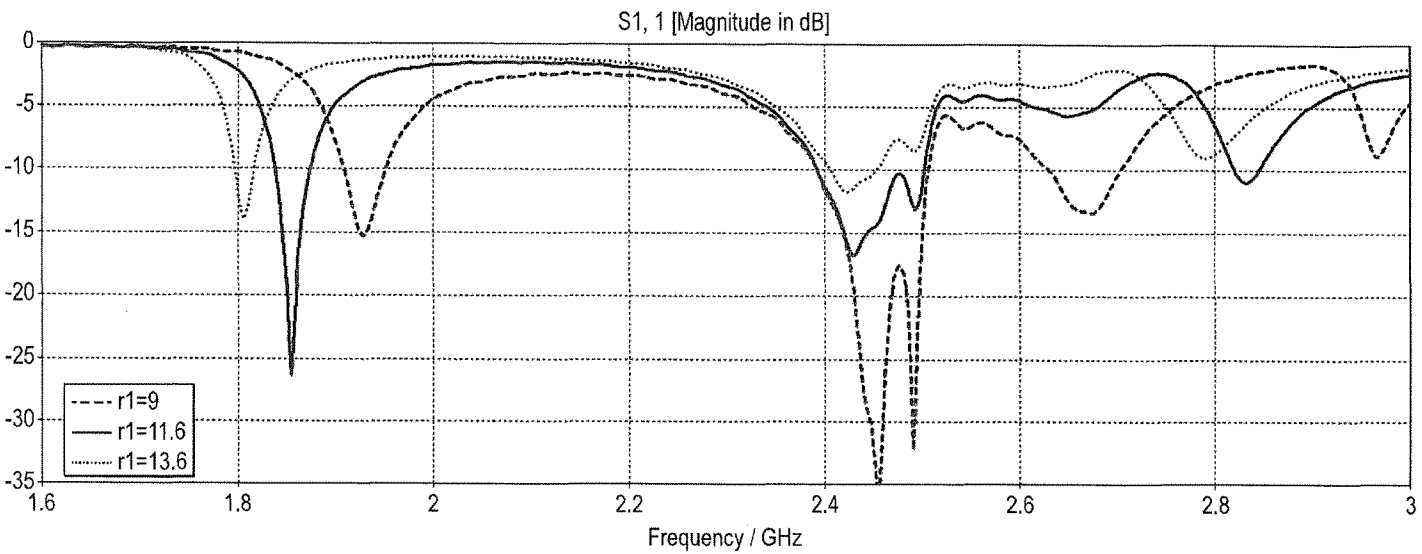
FIG. 7A comprises simulation results showing how the magnitude of the S-parameter S11 varies with frequency for changes in the radius of the first ground plane slot to the centre of the slot.
Figure 7B:
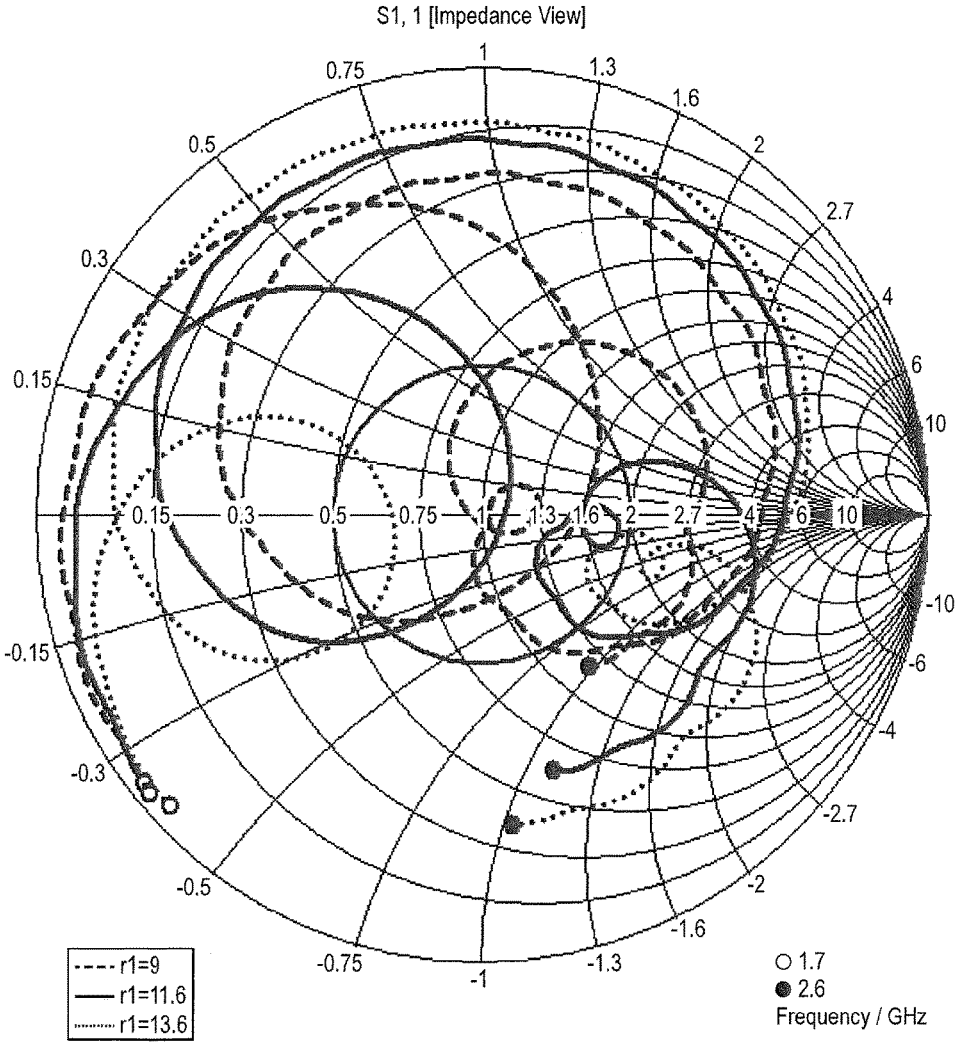
FIG. 7B comprises simulation results showing a Smith Chart of the variation in the S-parameter S11 with frequency for changes in the radius of the first ground plane slot to the centre of the slot.

FIGS. 7A and 7B show the simulation results for the parameter r1, namely the radius of the first ground plane slot 1021 to the centre of the slot. The simulation results show variations in S11 over the relevant frequency range for various values of the parameter r1. Referring to FIG. 7A, the simulation results demonstrate that acceptable performance is achieved when r1 is between 9 mm and 13.6 mm.

Figure 8A:
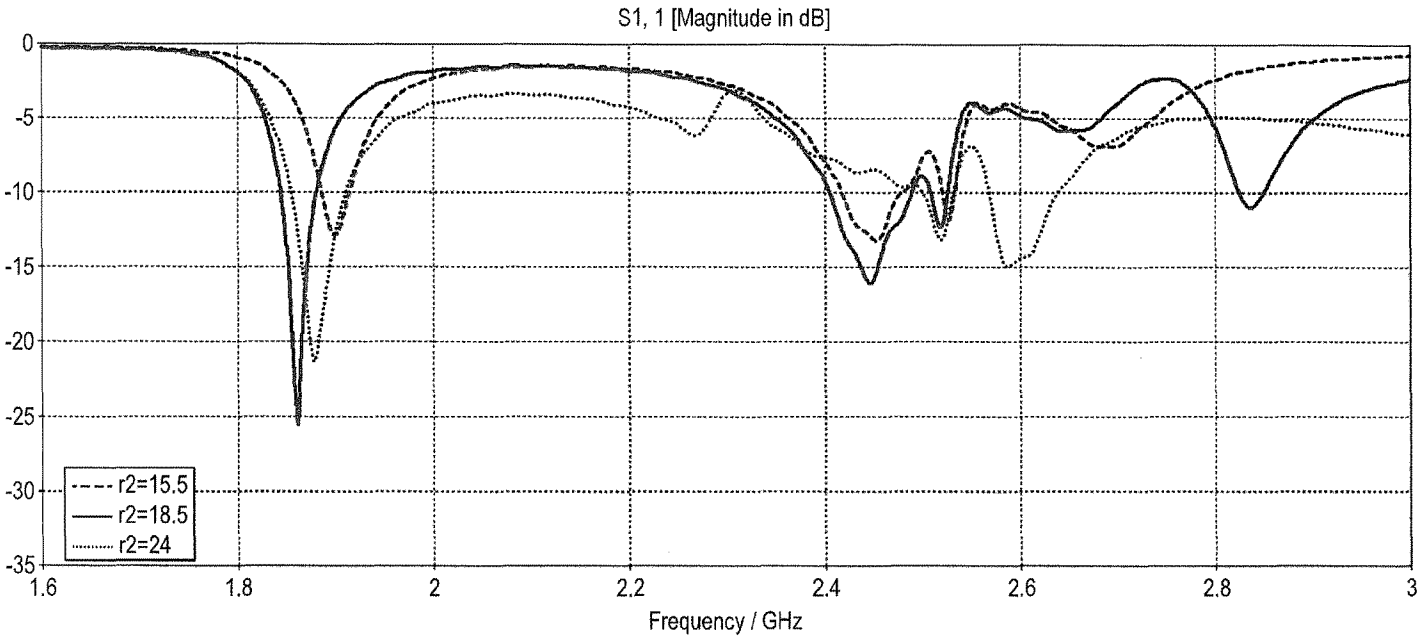
FIG. 8A comprises simulation results showing how the magnitude of the S-parameter S11 varies with frequency for changes in the radius of the second ground plane slot to the centre of the slot.
Figure 8B:
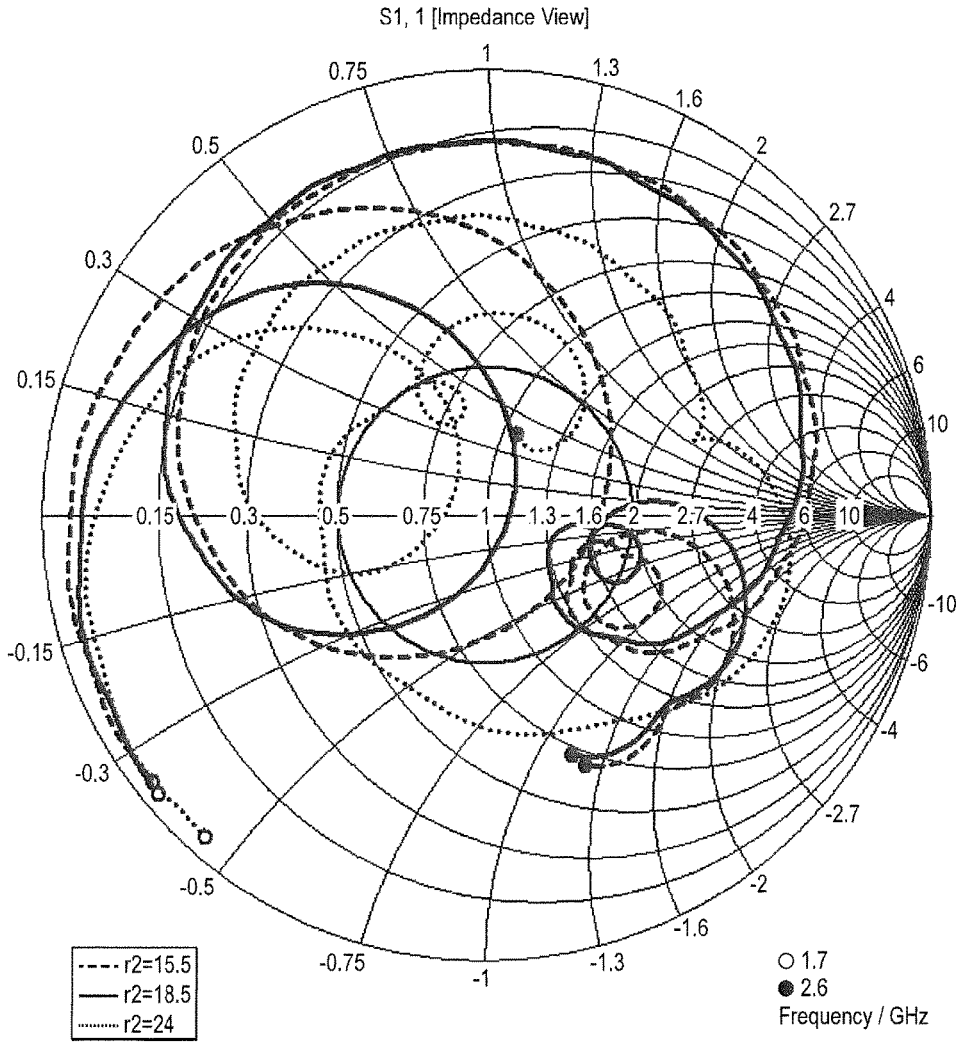
FIG. 8B comprises simulation results showing a Smith Chart of the variation in the S-parameter S11 with frequency for changes in the radius of the second ground plane slot to the centre of the slot.

FIGS. 8A and 8B show the simulation results for the parameter r2, namely the radius of the second ground plane slot 3022 to the centre of the slot. The simulation results show variations in S11 over the relevant frequency range for various values of the parameter r2. Referring to FIG. 8A, the simulation results demonstrate that acceptable performance is achieved when r2 is between 15.5 mm and 24 mm.

Figure 9A:
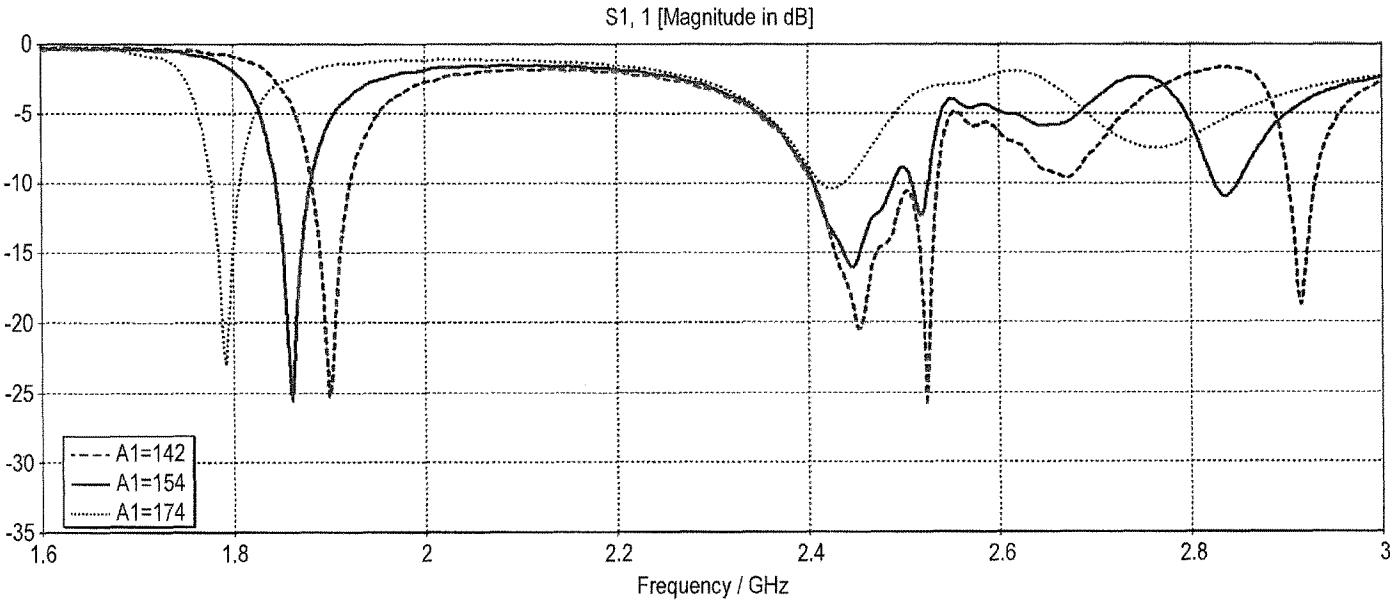
FIG. 9A comprises simulation results showing how the magnitude of the S-parameter S11 varies with frequency for changes in the arc angle of the first ground plane slot.
Figure 9B:
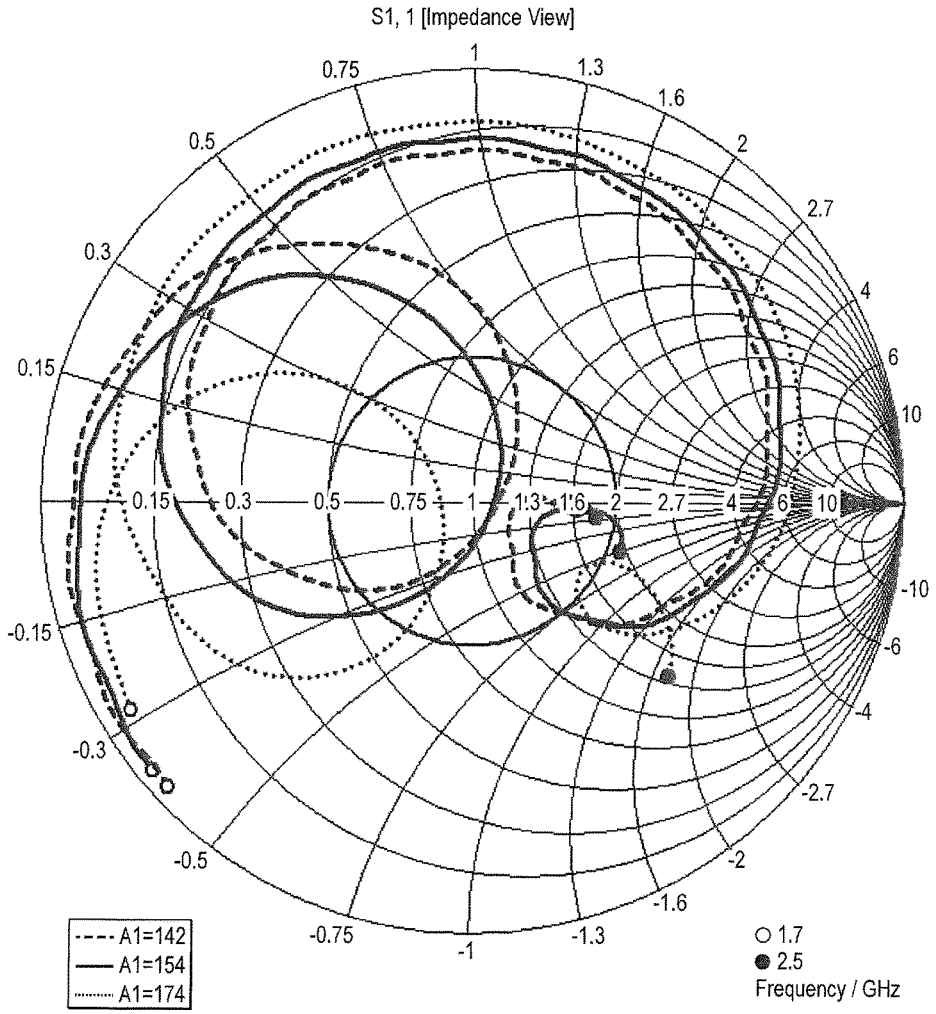
FIG. 9B comprises simulation results showing a Smith Chart of the variation in the S-parameter S11 with frequency for changes in the arc angle of the first ground plane slot.

FIGS. 9A and 9B show the simulation results for the parameter A1, namely the arc angle of the first ground plane slot 1021. The simulation results show variations in S11 over the relevant frequency range for various values of the parameter A1. Referring to FIG. 9A, the simulation results demonstrate that acceptable performance is achieved when A1 is between 142° and 174°.

Figure 10A:
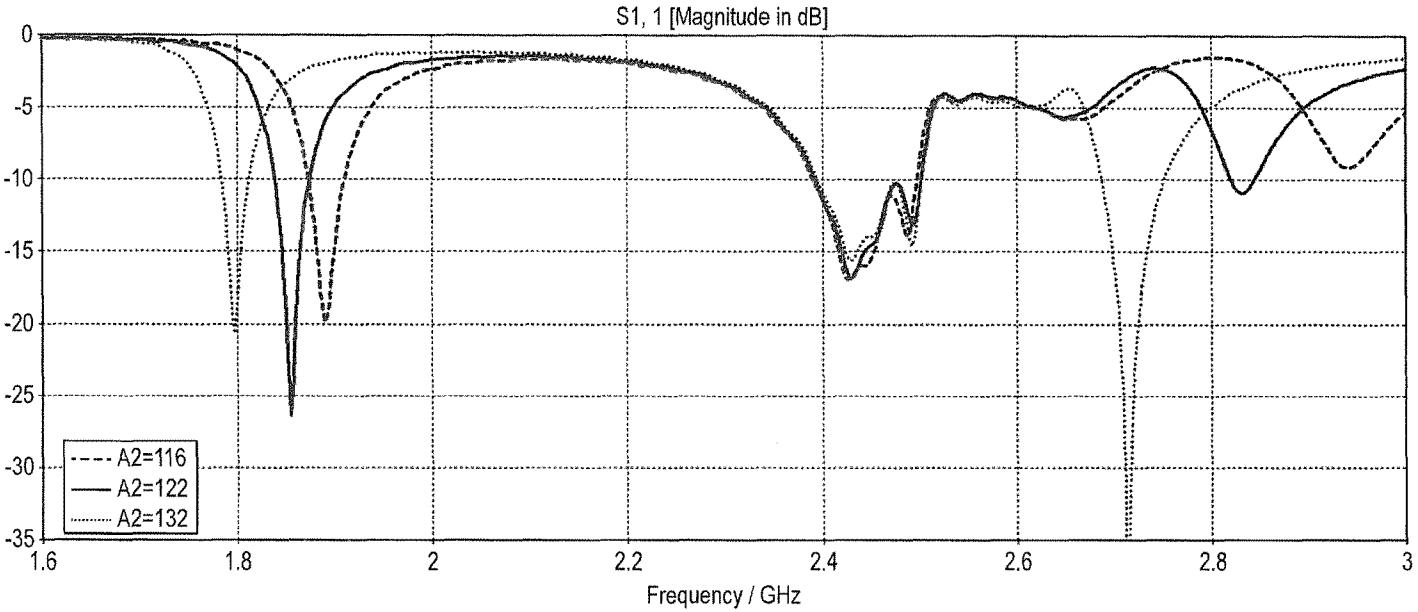
FIG. 10A comprises simulation results showing how the magnitude of the S-parameter S11 varies with frequency for changes in the arc angle of the second ground plane slot.
Figure 10B:
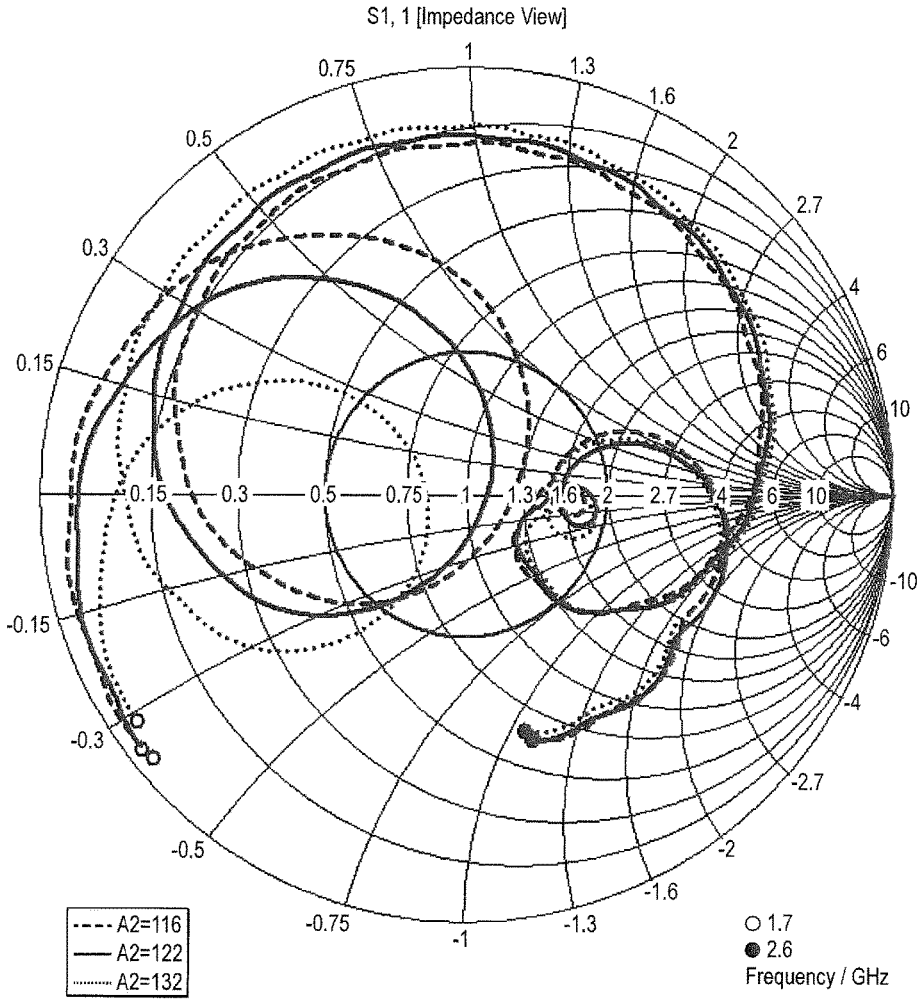
FIG. 10B comprises simulation results showing a Smith Chart of the variation in the S-parameter S11 with frequency for changes in the arc angle of the second ground plane slot.

FIGS. 10A and 10B show the simulation results for the parameter A2, namely the arc angle of the second ground plane slot 3022. The simulation results show variations in S11 over the relevant frequency range for various values of the parameter A2. Referring to FIG. 10A, the simulation results demonstrate that acceptable performance is achieved when A2 is between 116° and 132°.

Figure 11A:
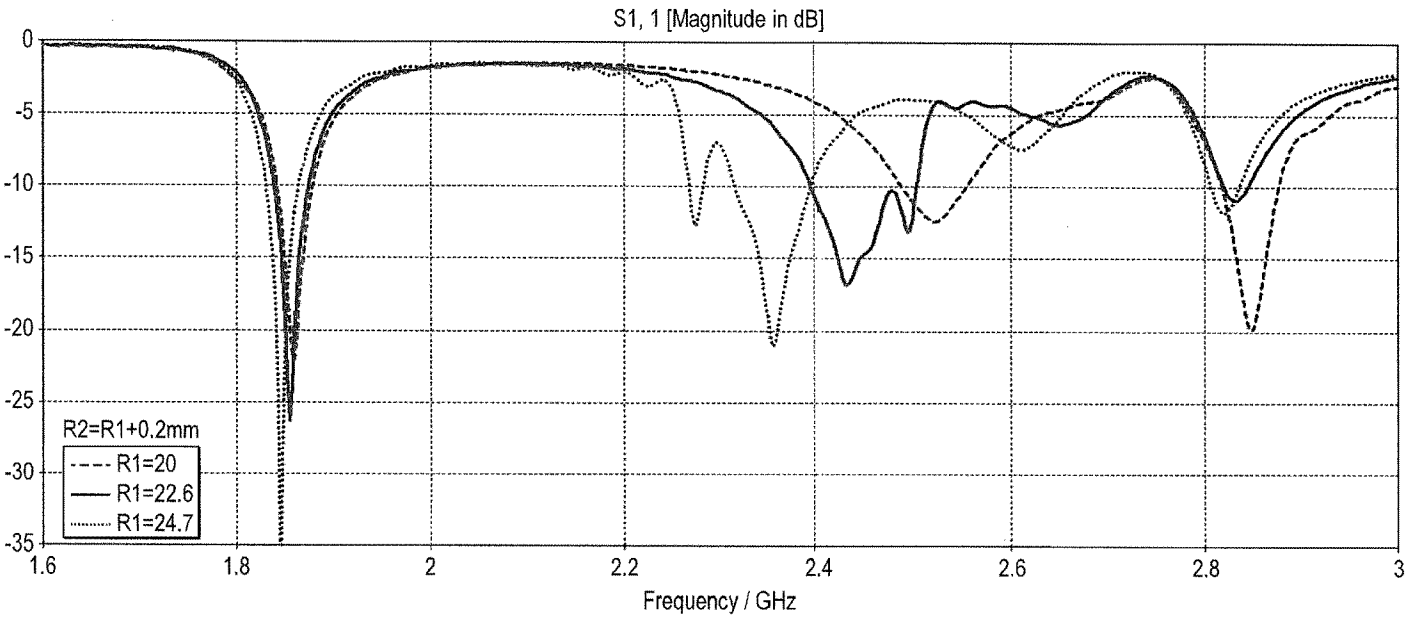
FIG. 11A comprises simulation results showing how the magnitude of the S-parameter S11 varies with frequency for changes in the radius from the centre of the inner section of the radiator to the outer edge of the inner section.
Figure 11B:
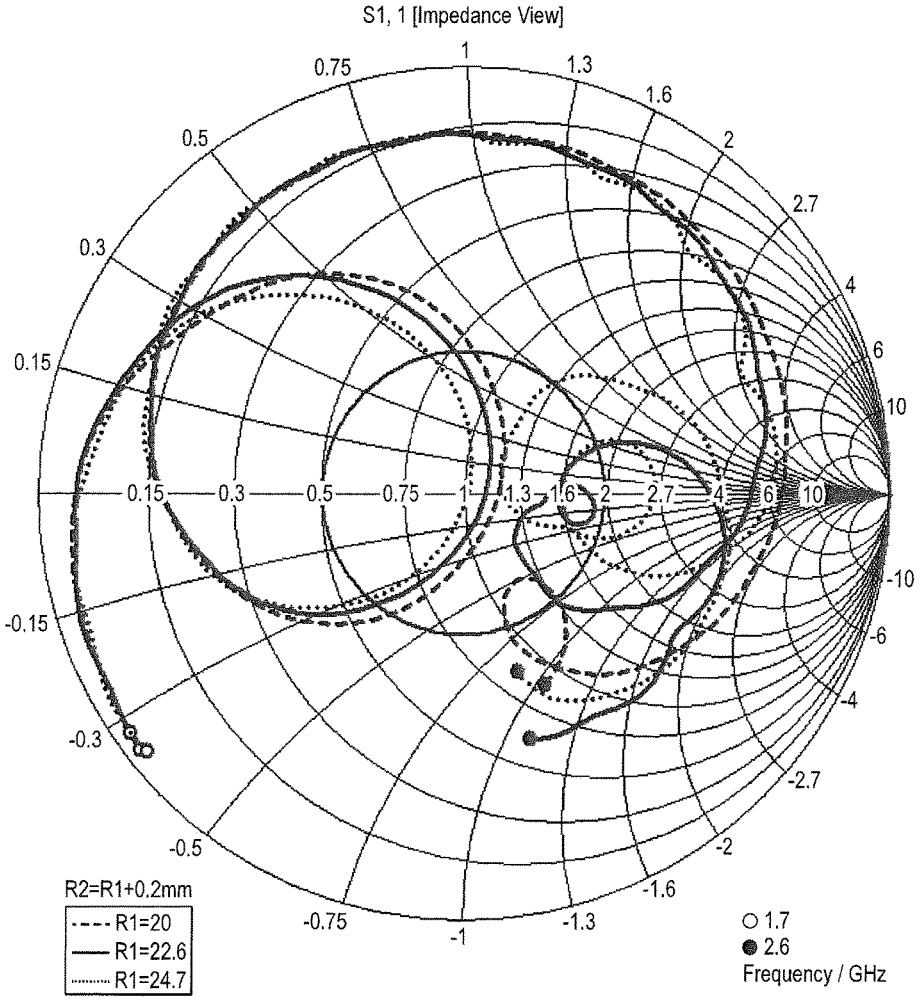
FIG. 11B comprises simulation results showing a Smith Chart of the variation in the S-parameter S11 with frequency for changes in the radius from the centre of the inner section of the radiator to the outer edge of the inner section.

FIGS. 11A and 11B show the simulation results for the parameter R1, namely the radius from the centre of the inner section 3030 of the radiator 103 to the outer edge of the inner section 3030. The simulation results show variations in S11 over the relevant frequency range for various values of the parameter R1. Referring to FIG. 11A, the simulation results demonstrate that acceptable performance is achieved when R1 is between 20 mm and 24.7 mm.

Figure 12A:
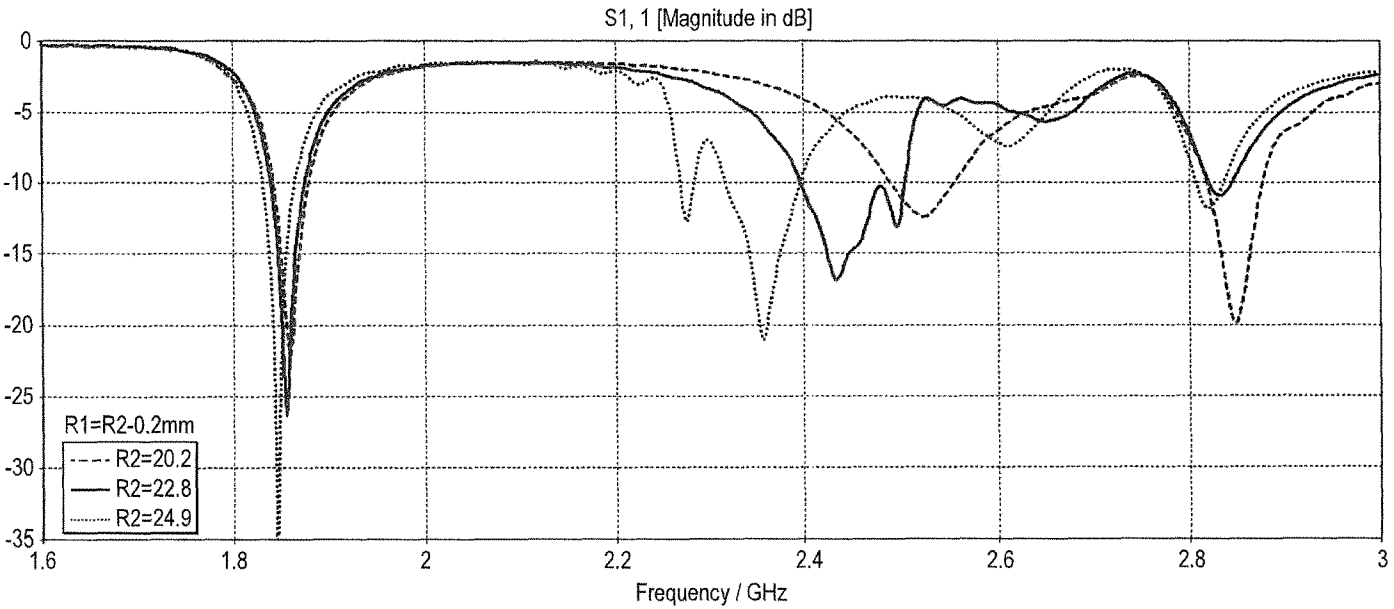
FIG. 12A comprises simulation results showing how the magnitude of the S-parameter S11 varies with frequency for changes in the distance from the centre of the inner section of the radiator to the inside edge of the outer ring of the outer section of the radiator.
Figure 12B:
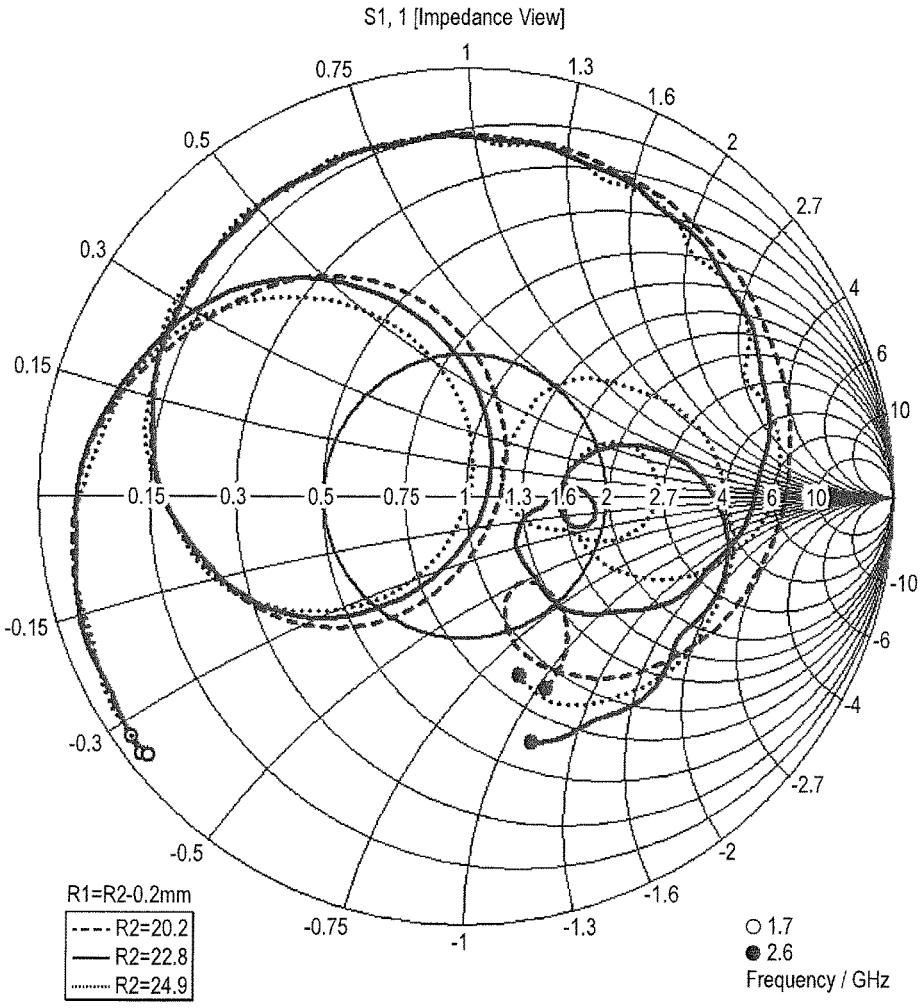
FIG. 12B comprises simulation results showing a Smith Chart of the variation in the S-parameter S11 with frequency for changes in the distance from the centre of the inner section of the radiator to the inside edge of the outer ring of the outer section of the radiator.

FIGS. 12A and 12B show the simulation results for the parameter R2, namely the distance from the centre of the inner section 3030 of the radiator 103 to the inside edge of the outer ring of the outer section 3032 of the radiator 103. The simulation results show variations in S11 over the relevant frequency range for various values of the parameter R2. Referring to FIG. 12A, the simulation results demonstrate that acceptable performance is achieved when R2 is between 20.2 mm and 24.9 mm.

Figure 13A:
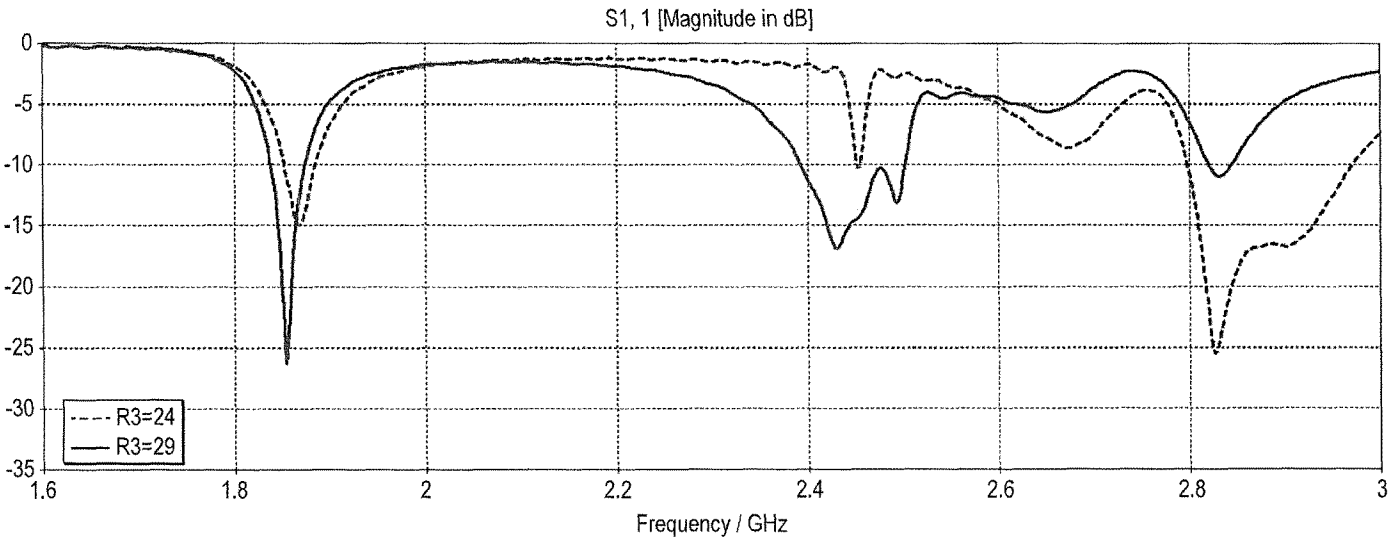
FIG. 13A comprises simulation results showing how the magnitude of the S-parameter S11 varies with frequency for changes in the distance from the centre of the inner section of the radiator to the outside edge of the outer ring of the outer section of the radiator.
Figure 13B:
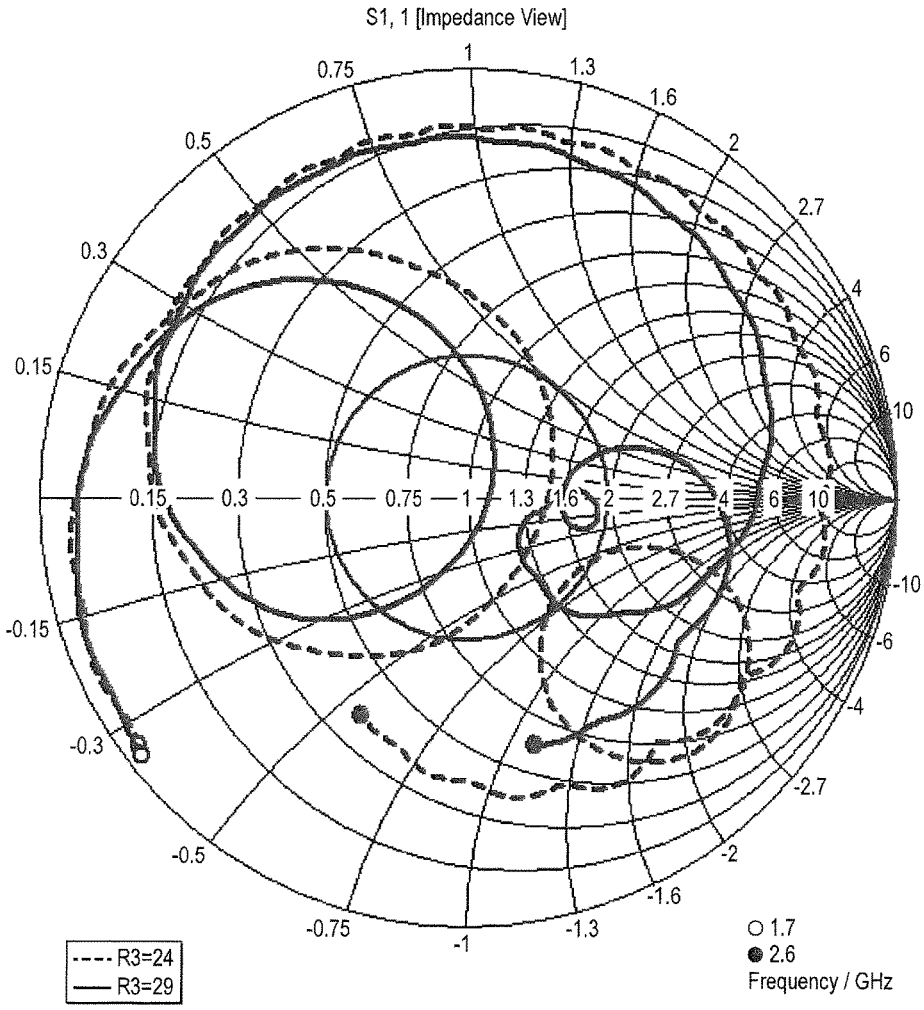
FIG. 13B comprises simulation results showing a Smith Chart of the variation in the S-parameter S11 with frequency for changes in the distance from the centre of the inner section of the radiator to the outside edge of the outer ring of the outer section of the radiator.

FIGS. 13A and 13B show the simulation results for the parameter R3, namely the distance from the centre of the inner section 3030 of the radiator 103 to the outside edge of the outer ring of the outer section 3032. The simulation results show variations in S11 over the relevant frequency range for various values of the parameter R3. Referring to FIG. 13A, the simulation results demonstrate that acceptable performance is achieved when R3 is between 24 mm and 29 mm.

Figure 14A:
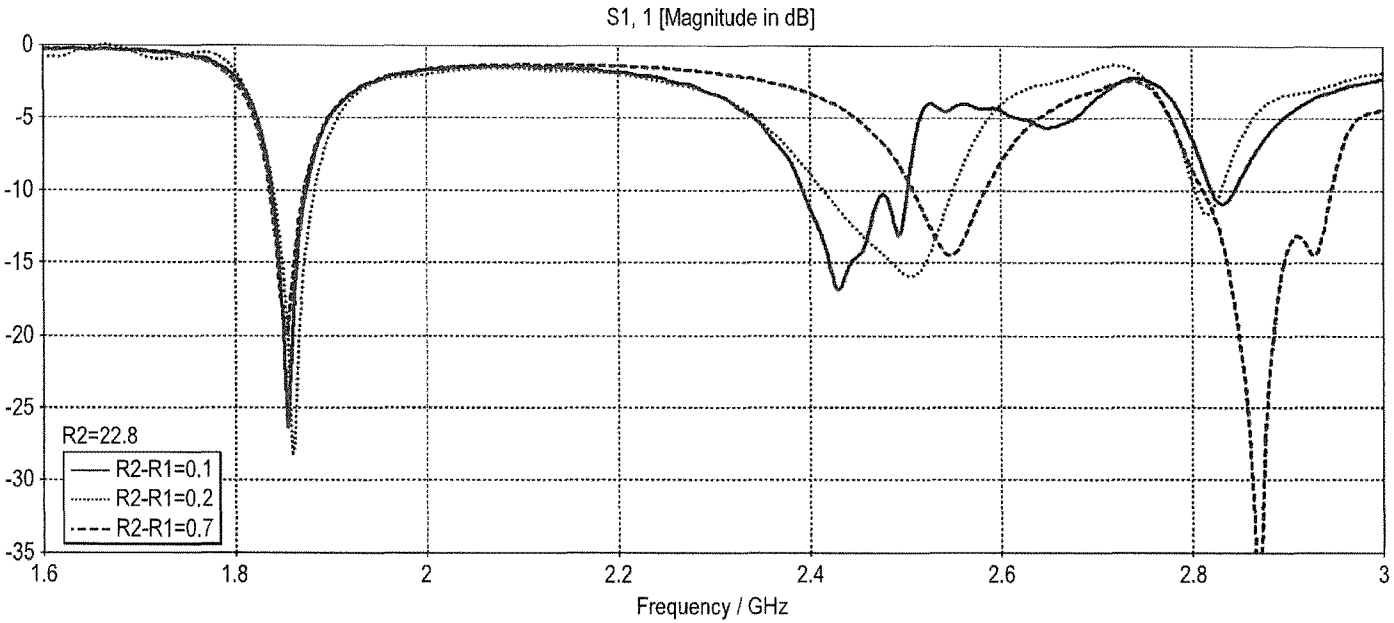
FIG. 14A comprises simulation results showing how the magnitude of the S-parameter S11 varies with frequency for changes in the width of the separating ring between the inner and outer sections of the radiator.
Figure 14B:
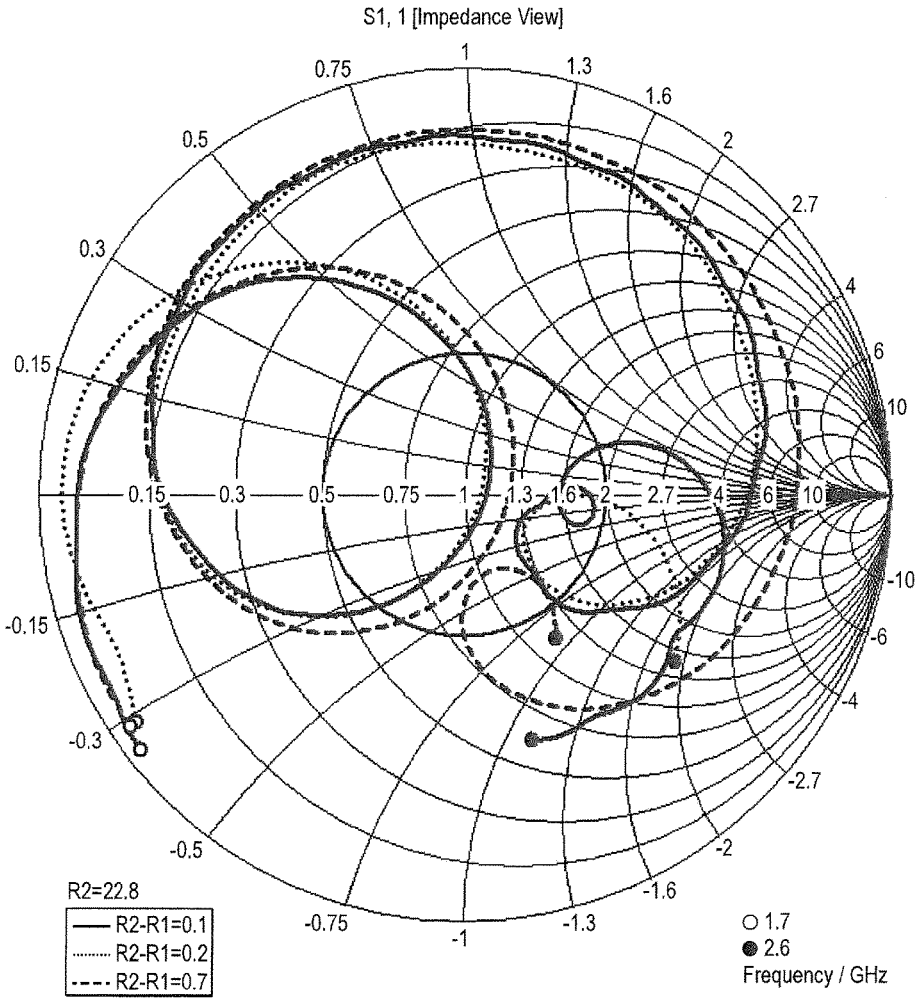
FIG. 14B comprises simulation results showing a Smith Chart of the variation in the S-parameter S11 with frequency for changes in the width of the separating ring between the inner and outer sections of the radiator.

FIGS. 14A and 14B show the simulation results for the parameter R2−R1, namely the width of separating ring 3033. The simulation results show variations in S11 over the relevant frequency range for various values of the parameter R2−R1. Referring to FIG. 14A, the simulation results demonstrate that acceptable performance is achieved when R2−R1 is between 0.1 mm and 0.7 mm.

Figure 15A:
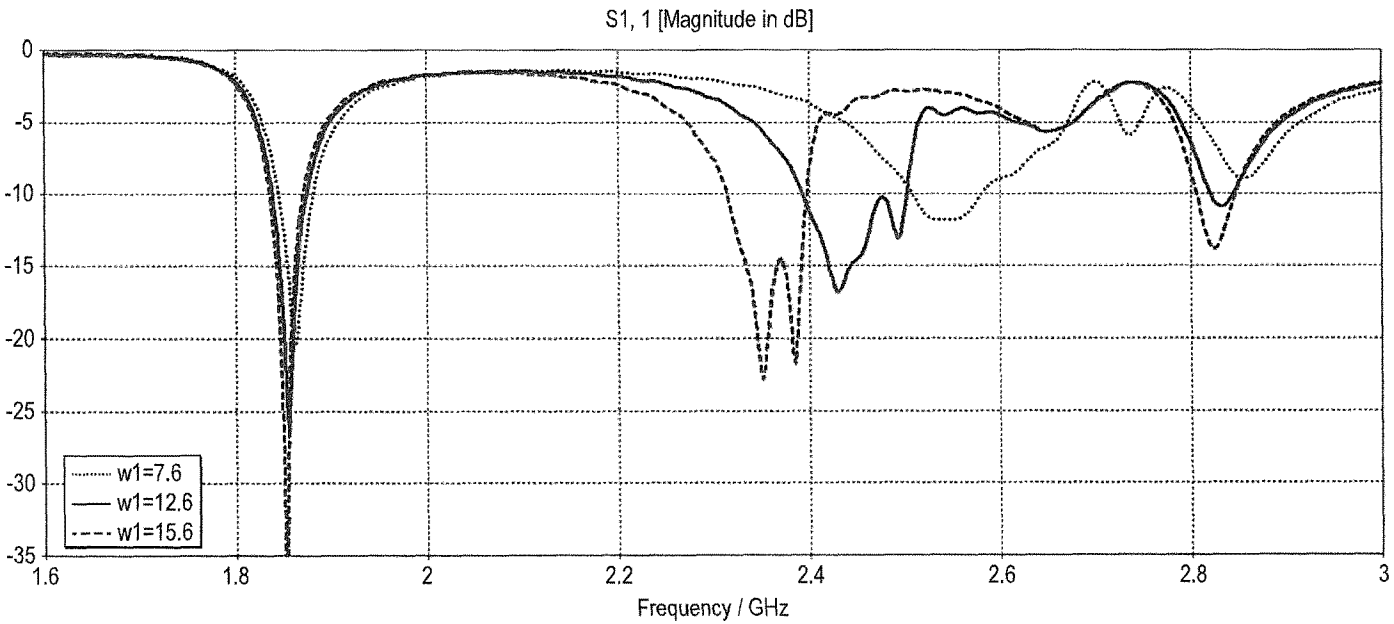
FIG. 15A comprises simulation results showing how the magnitude of the S-parameter S11 varies with frequency for changes in the length of each of the first and second inner radiator slots.
Figure 15B:
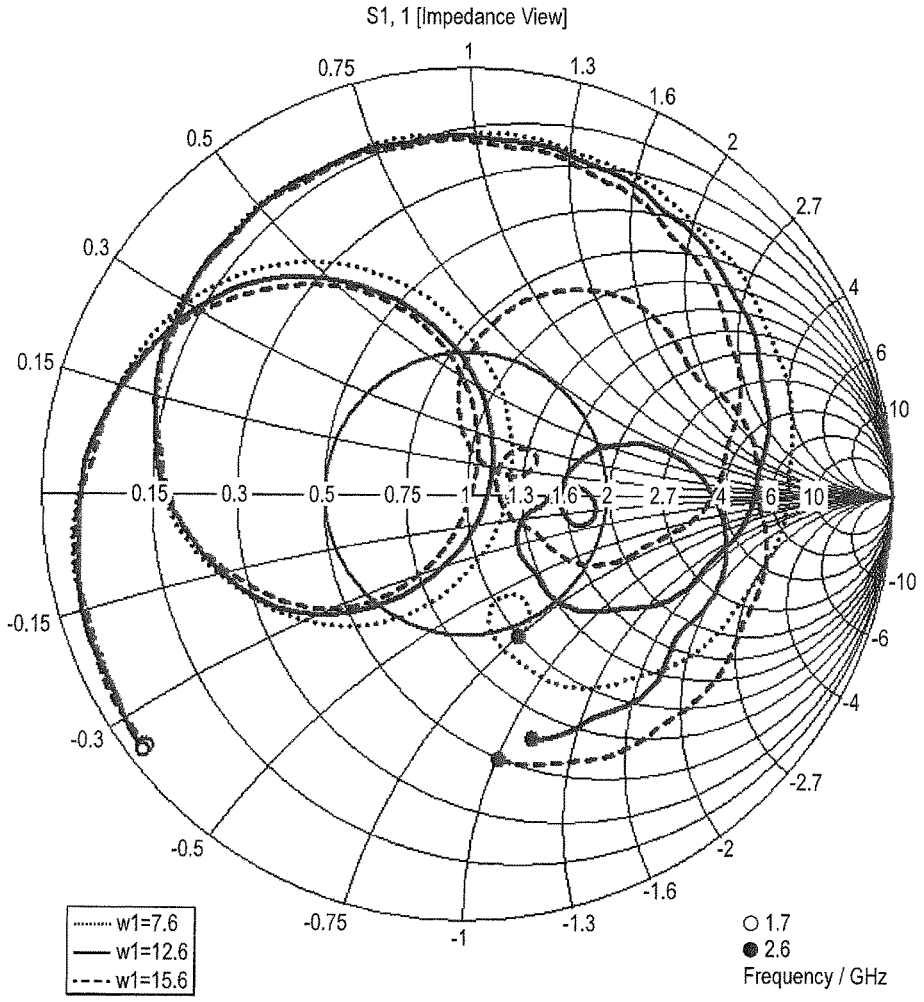
FIG. 15B comprises simulation results showing a Smith Chart of the variation in the S-parameter S11 with frequency for changes in the length of each of the first and second inner radiator slots.

FIGS. 15A and 15B show the simulation results for the parameter w1, namely the length of each of the first 3034 and second 3035 inner radiator slots. The simulation results show variations in S11 over the relevant frequency range for various values of the parameter w1. Referring to FIG. 15A, the simulation results demonstrate that acceptable performance is achieved when w1 is between 7.6 mm and 15.6 mm.

Figure 16A:
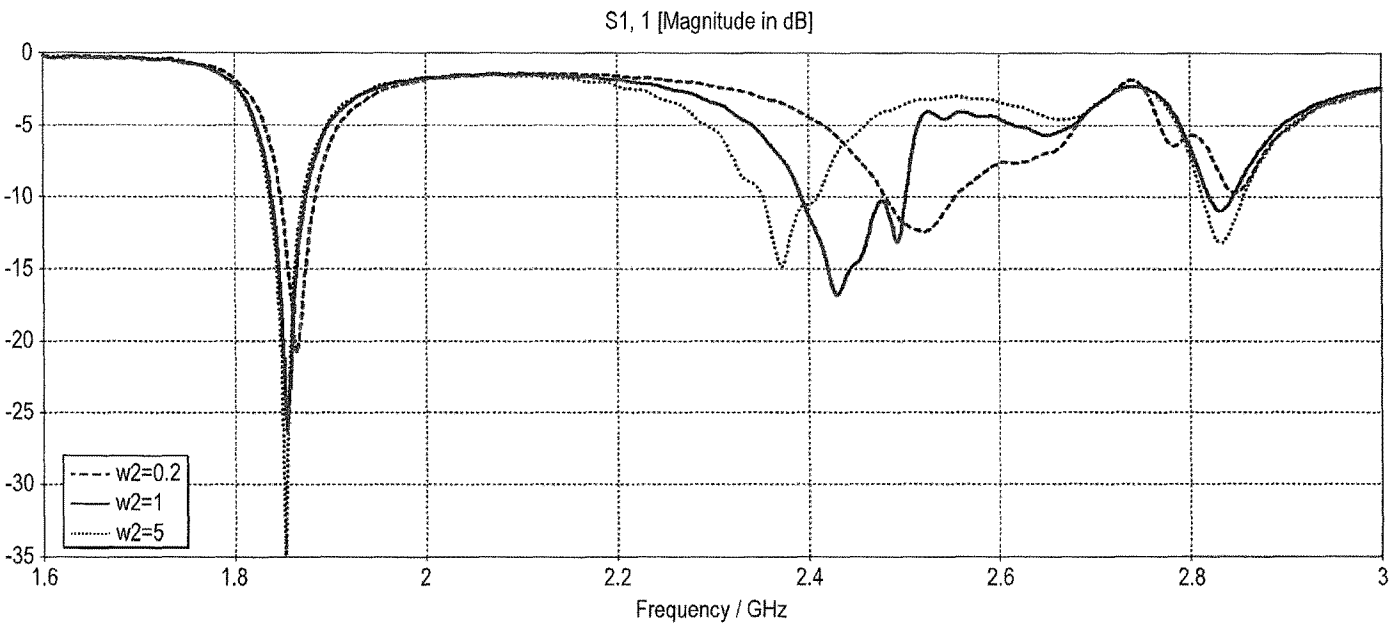
FIG. 16A comprises simulation results showing how the magnitude of the S-parameter S11 varies with frequency for changes in the width of the first and second inner radiator slots and/or the width of the first and second outer radiator slots.
Figure 16B:
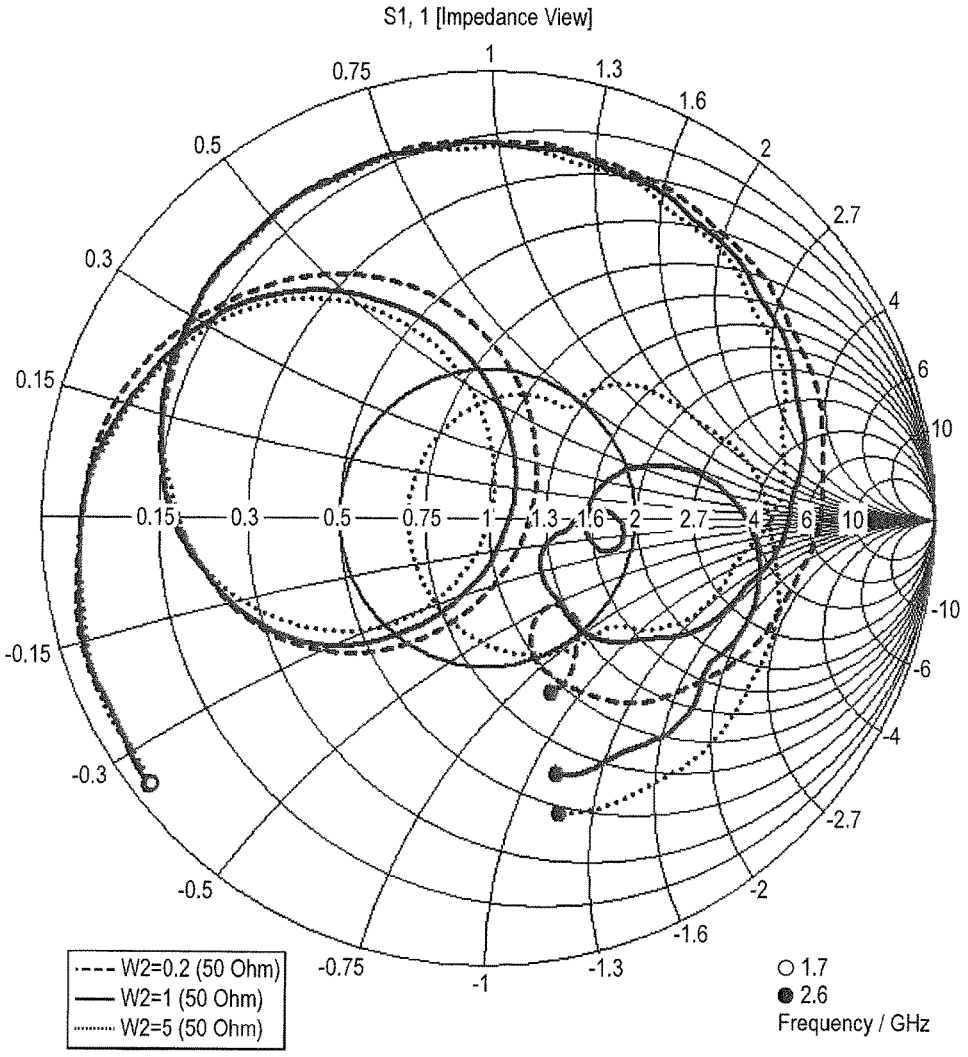
FIG. 16B comprises simulation results showing a Smith Chart of the variation in the S-parameter S11 with frequency for changes in the width of the first and second inner radiator slots and/or the width of the first and second outer radiator slots.

FIGS. 16A and 16B show the simulation results for the parameter w2, namely the width of the first 3034 and second 3035 inner radiator slots and/or the first 3036 and second 3037 outer radiator slots. The simulation results show variations in S11 over the relevant frequency range for various values of the parameter w2. Referring to FIG. 16A, the simulation results demonstrate that acceptable performance is achieved when w2 is between 0.2 mm and 5 mm.

Figure 17A:
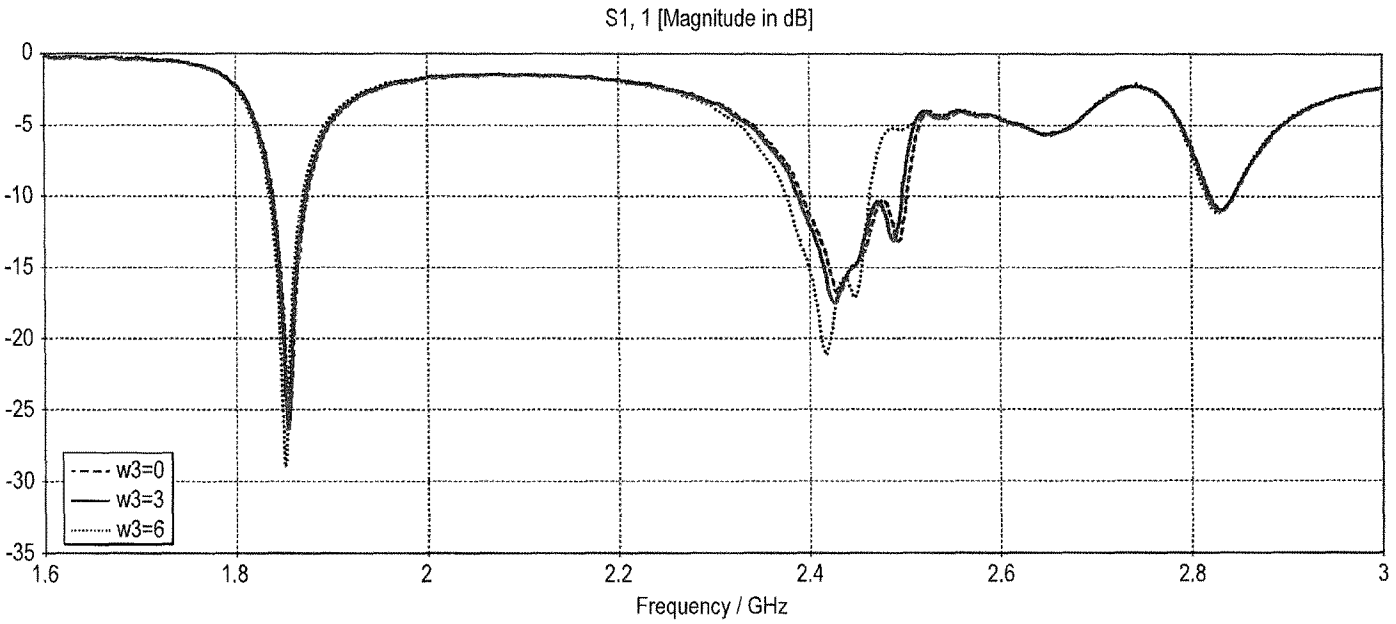
FIG. 17A comprises simulation results showing how the magnitude of the S-parameter S11 varies with frequency for changes in the length of each of the first and second outer radiator slots.
Figure 17B:
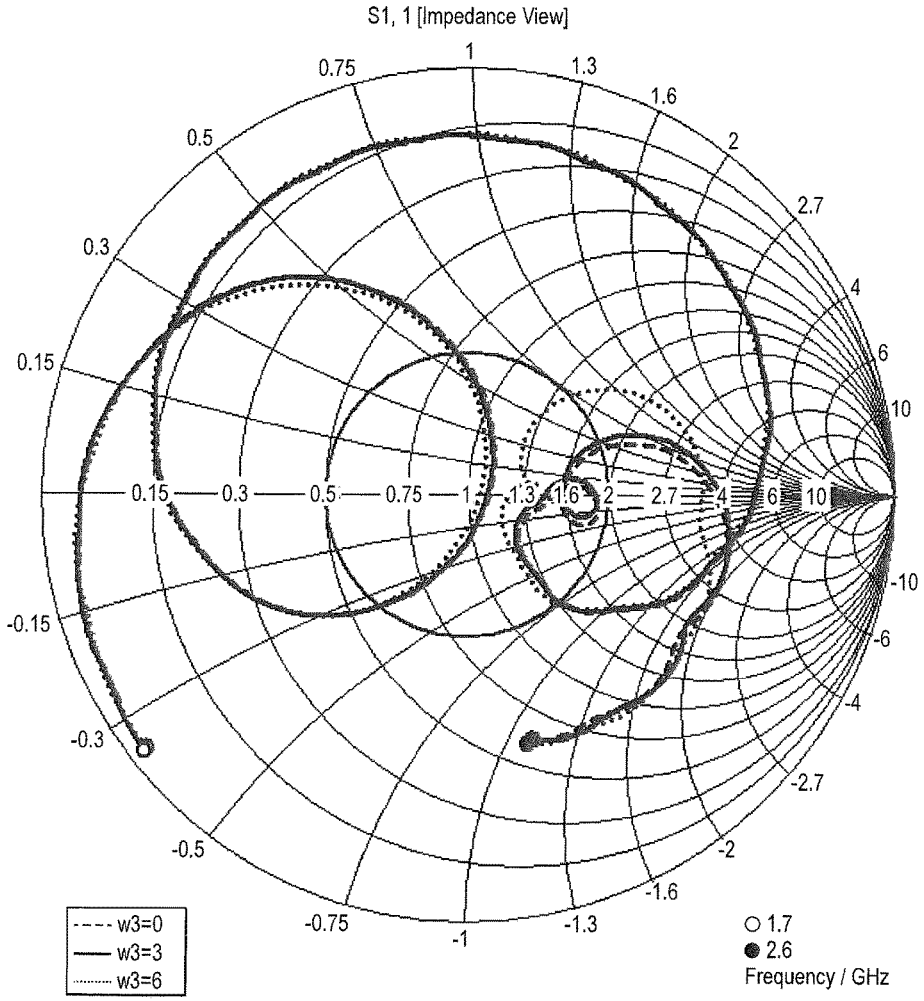
FIG. 17B comprises simulation results showing a Smith Chart of the variation in the S-parameter S11 with frequency for changes in the length of each of the first and second outer radiator slots.

FIGS. 17A and 17B show the simulation results for the parameter w3, namely the length of each of the first 3036 and second 3037 outer radiator slots. The simulation results show variations in S11 over the relevant frequency range for various values of the parameter w3. Referring to FIG. 17A, the simulation results demonstrate that the outer radiator slots 3036, 3037 need not be present (w3=0 mm) to achieve acceptable performance and that, when the outer radiator slots 3036, 3037 are present, acceptable performance is achieved when w3 is greater than 0 mm and less than or equal to 6 mm.

Figure 18A:
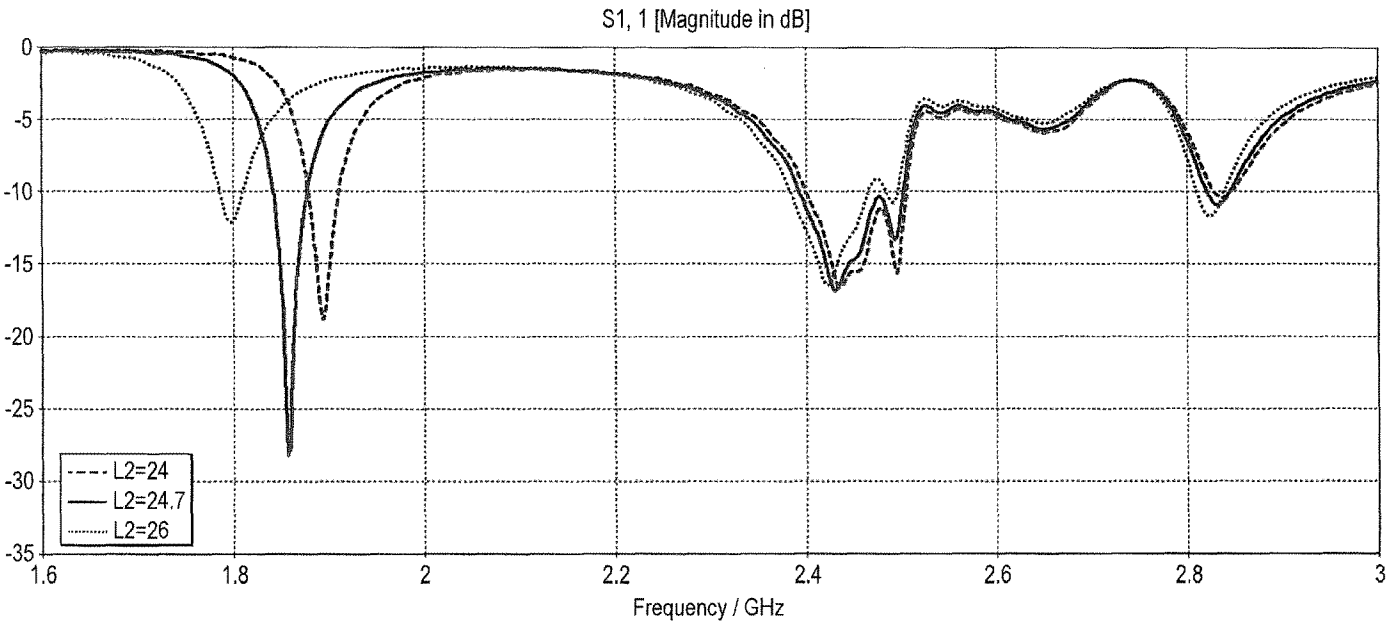
FIG. 18A comprises simulation results showing how the magnitude of the S-parameter S11 varies with frequency for changes in the length of the outgoing feed of the feedline.
Figure 18B:
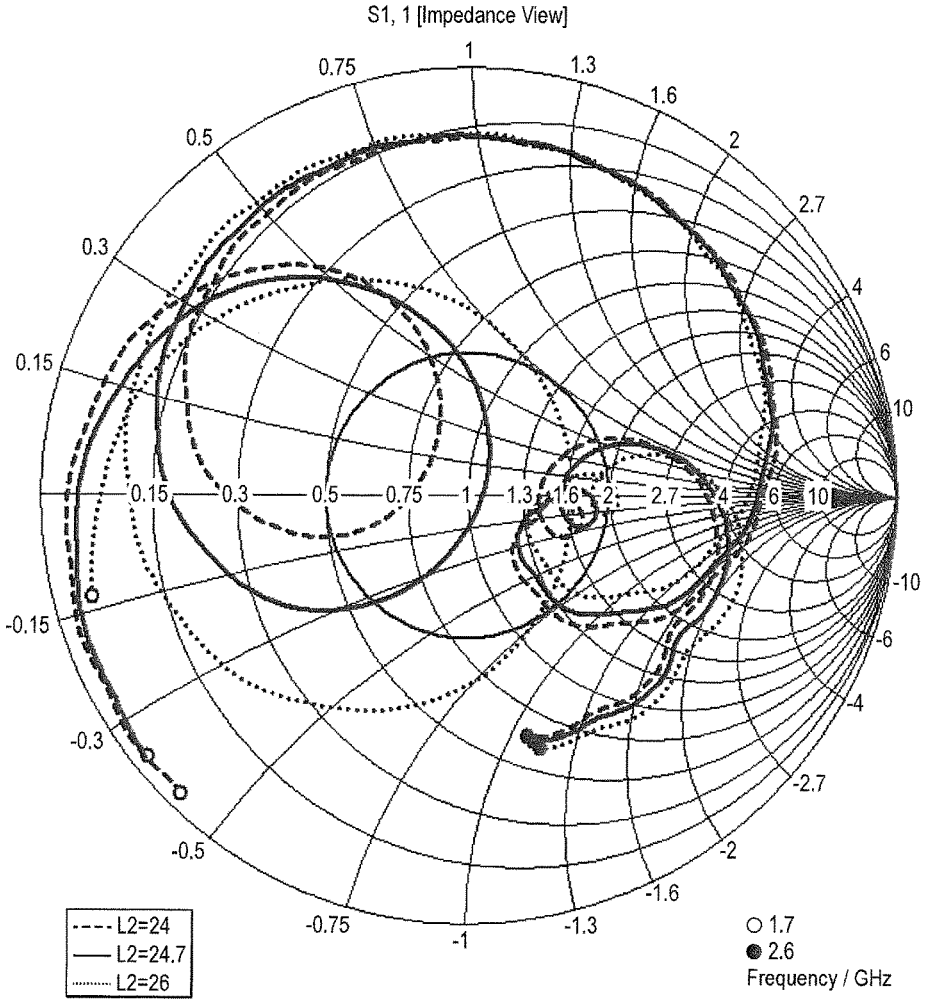
FIG. 18B comprises simulation results showing a Smith Chart of the variation in the S-parameter S11 with frequency for changes in the length of the outgoing feed of the feedline.

FIGS. 18A and 18B show the simulation results for the parameter L2, namely the length of the outgoing feed of the feedline 101. The simulation results show variations in S11 over the relevant frequency range for various values of the parameter L2. Referring to FIG. 18A, the simulation results demonstrate that acceptable performance is achieved when L2 is between 24 mm and 26 mm.

Figure 19A:
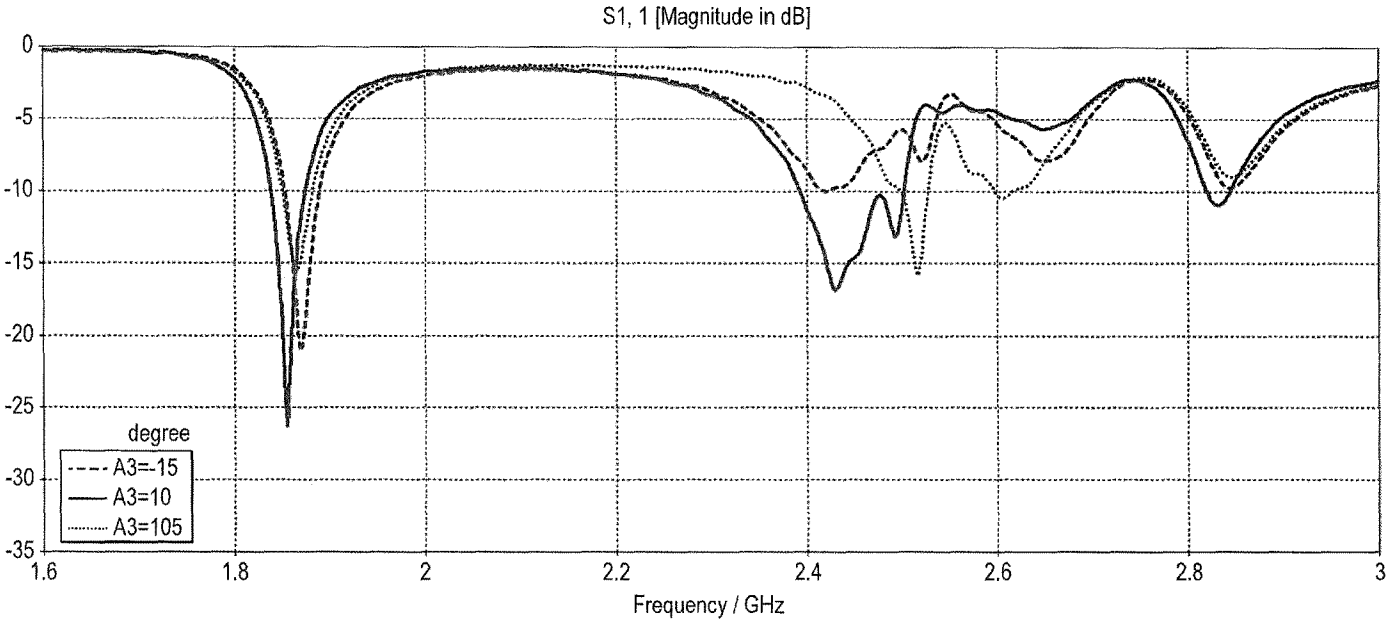
FIG. 19A comprises simulation results showing how the magnitude of the S-parameter S11 varies with frequency for changes in the angle between the diameter on which the first and second inner radiator slots lie and the path of the outgoing feed when the plane of the inner radiator slots is projected into the plane of the feedline.
Figure 19B:
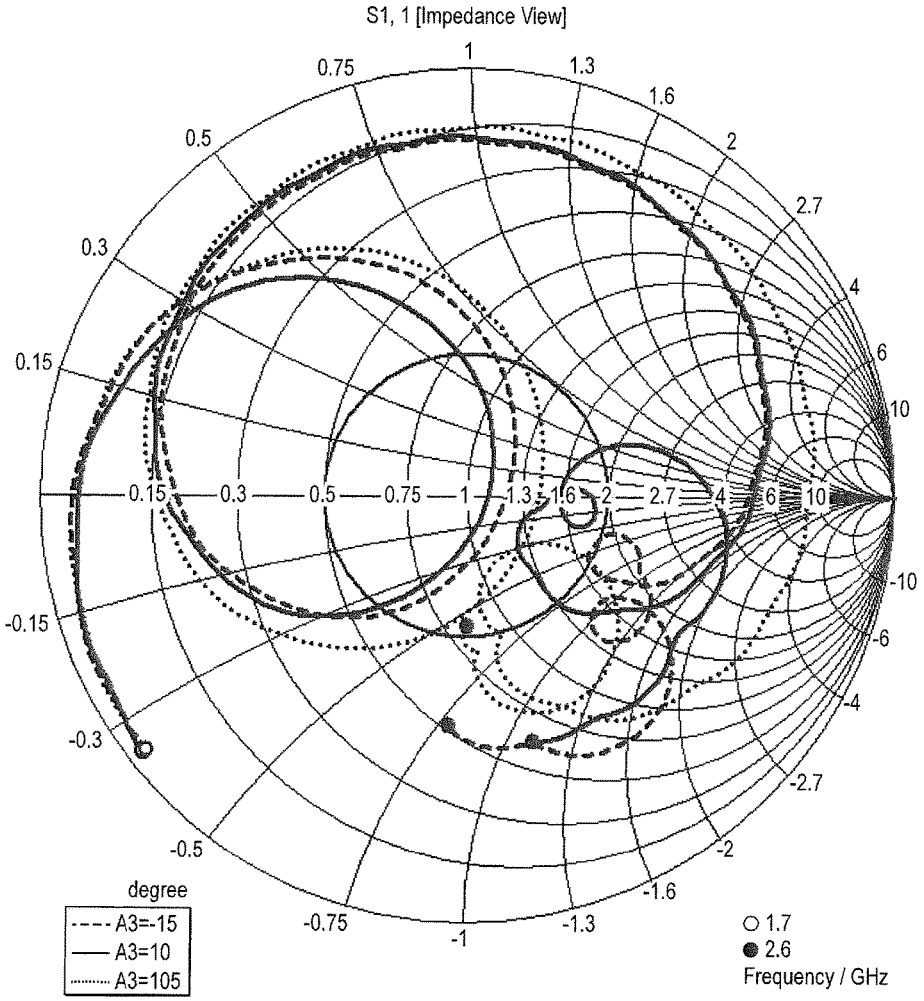
FIG. 19B comprises simulation results showing a Smith Chart of the variation in the S-parameter S11 with frequency changes for changes in the angle between the diameter on which the first and second inner radiator slots lie and the path of the outgoing feed when the plane of the inner radiator slots is projected into the plane of the feedline.

FIGS. 19A and 19B show the simulation results for the parameter A3, namely the angle between the diameter on which the first and second inner radiator slots 3034, 3035 and the first and second outer radiator slots 3036, 3037 lie and the path of the outgoing feed when the plane of the ground plane is projected into the plane of the feedline (or vice versa). The simulation results show variations in S11 over the relevant frequency range for various values of the parameter A3. Referring to FIG. 19A, the simulation results demonstrate that acceptable performance is achieved when A3 is between −15° and 105°.

MODIFICATIONS AND VARIATIONS

In the embodiments described above, each ground plane slot 1021, 3022 is a circular arc. However, instead of being a circular arc, one or both of the ground plane slots may be any shape which intersects with the path of the feedline 101 at a first position on the first arm 1011 and a second position on the second arm 1012 when the plane of the ground plane 102 is projected onto the plane of the feedline 101 (or vice versa). For example a ground plane slot may be formed as a non-circular arc, such as an elliptical arc. The present inventors have found that performance is maximised when a ground plane slot is a circular arc and deteriorates as the arc becomes more elliptical. However, acceptable performance can be achieved when the ground plane slot is only slightly elliptical. Alternatively, the ground plane slot 1021 may be formed of straight lines.

In the embodiments described above, the radiator 103 is circular. However, the present inventors have found that acceptable antenna performance can be achieved when the radiator is slightly elliptical, with an ellipticity between 0.97 and 1.03, the ellipticity of an ellipse being defined as the ratio of the minor diameter of the ellipse and the major diameter of the ellipse. Accordingly, the term "circular" and the like when referring to the radiator should not be construed to mean strictly circular but should instead be construed to encompass such variations.

Any number of ground plane slots may be provided in the ground plane of embodiments, with a ground plane slot being provided for each waveband at which signals or energy is to be transmitted and/or received. For example, a third ground plane slot could be provided in the ground plane to provide tri-band transmission and/or reception capabilities.

In the embodiments described above, the gap between the ground plane 102 and the radiator 103 is an air gap. However, instead, the gap could be filled with foam, textile, rubber, paper, composites, polycarbonate, polyimide, kapton, silicon, or other suitable material.

In the embodiments described above, the outer radiator slots 3036, 3037 are on a diameter of the radiator 103 on opposite sides of the centre of the radiator 103 and on the outer edge of the outer section 3032 of the radiator 103. However, instead, the outer radiator slots 3036, 3037 could be on a diameter of the radiator 103 on opposite sides of the centre of the radiator 103 and on the inner edge of the outer section 3032 of the radiator 103.

Figure 20:
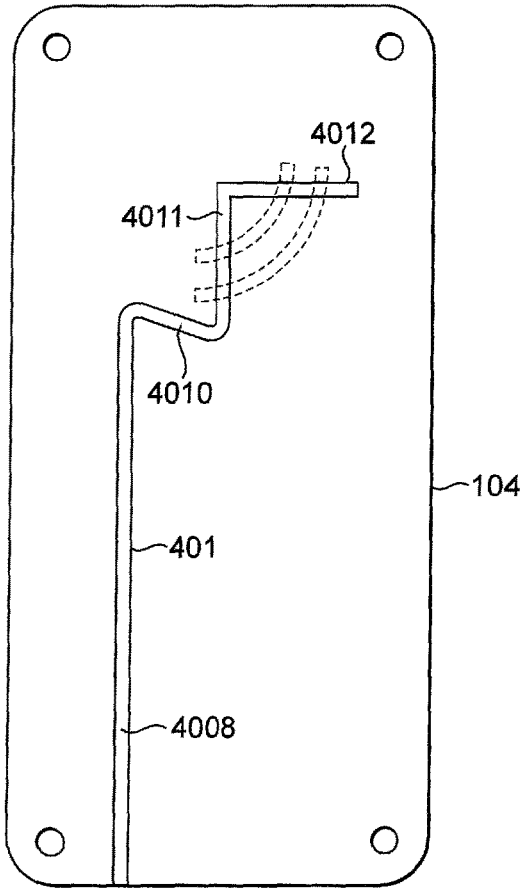
FIG. 20 shows a modification of previous embodiments.

A further modification is shown in FIG. 20. In this modification, the feedline 401 is not formed of just two straight arms, as in previous embodiments. Instead, the feedline 401 has multiple arms 4008, 4010, 4011, 4012 (four in the example of FIG. 20 although other numbers are possible). This has the advantage of freeing up space on the substrate 104 on which the feedline 401 is formed. This allows the feedline 401 to avoid any circuitry which may be present. Accordingly, the substrate can have thereon transmission and/or reception circuitry, so that the circuitry and antenna are integrated on one substrate. In the example shown in FIG. 20, arm 4012 is the output feed.

Figure 21C:
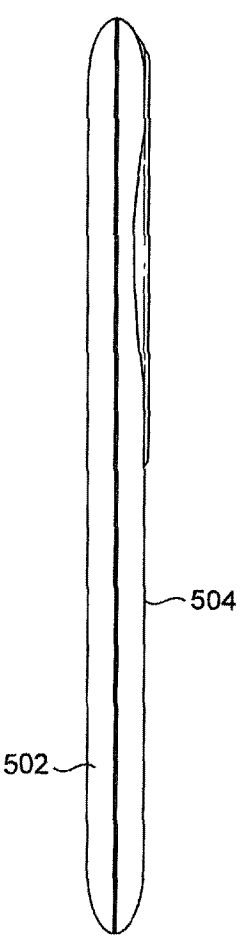
FIGS. 21A, 21B and 21C show a case for housing a feedline and ground plane, the case having a radiator printed or plated thereon.
Figure 21B:
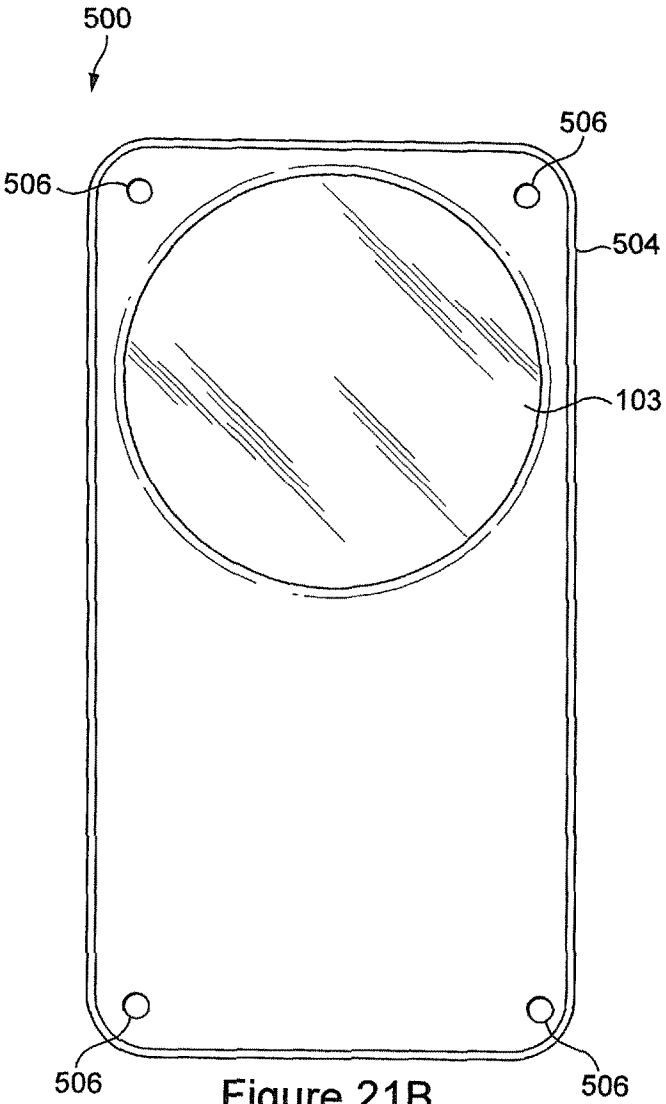
Figure 21A:
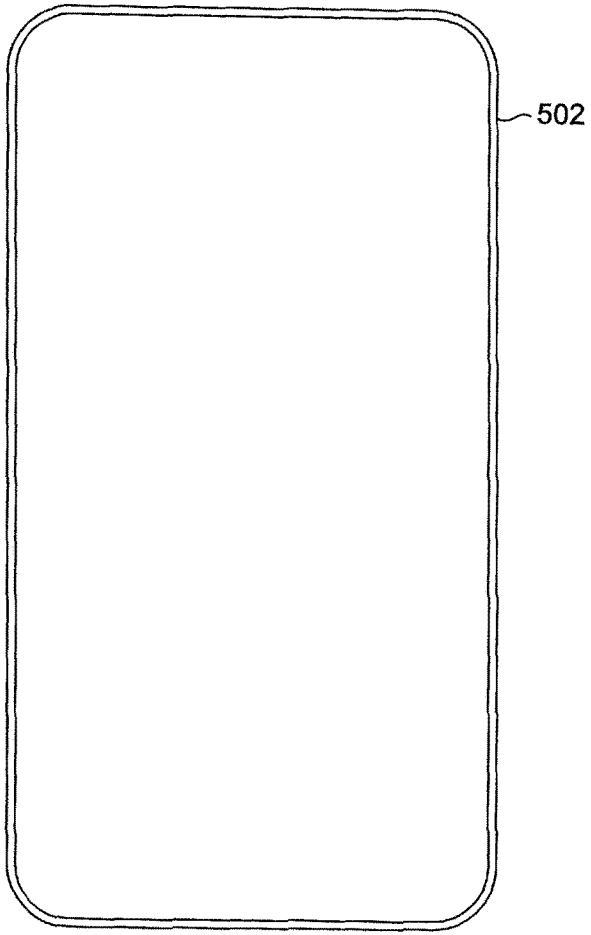

FIGS. 21A, 21B and 21C show a further modification in which a case 500 is provided to house the substrate 104 with the feedline and ground plane thereon, and in which the radiator 103 is printed or plated on the inside of the case 500. More particularly, referring to FIGS. 21A and 21B the case 500 comprises a base 502 and a lid 504. Lid 504 contains supports 506 to engage holes in substrate 104 to position and hold substrate 104 in a predetermined position relative to radiator 103, which is printed or plated on the inside of the lid 504. FIG. 21C shows the case 500 with the base 502 and lid 504 connected together to form a device housing an antenna. Printing or plating radiator 103 on the inside of case 500 provides a mechanical support for the radiator, while reducing manufacturing cost and reducing the manufacturing process time.

The foregoing description of embodiments of the invention has been presented for the purpose of illustration and description. It is not intended to be exhaustive or to limit the invention to the precise form disclosed. Alternations, modifications and variations can be made without departing from the spirit and scope of the present invention.

The invention claimed is:

1. An antenna comprising:

a feedline having a path in a first plane, the path having a first arm and a second arm perpendicular to the first arm;

a ground plane provided in a second plane spaced apart from, and parallel to, the first plane, the ground plane having a ground plane slot therein with a path in the second plane, wherein the path of the ground plane slot intersects the path of the feedline at a first position on the first arm and a second position on the second arm when the second plane is projected into the first plane;

a radiator separated from the feedline by the ground plane, the radiator being provided in a third plane spaced apart from, and parallel to, the second plane;

wherein the ground plane has a first ground plane slot and a second ground plane slot therein, each ground plane slot having a path in the second plane;

the path of the first ground plane slot intersects the path of the feedline at a first position on the first arm and a second position on the second arm when the second plane is projected into the first plane; and the path of the second ground plane slot intersects the path of the feedline at a third position on the first arm and a fourth position on the second arm when the second plane is projected into the first plane.

2. The antenna of claim 1, wherein at least one of the first and second ground plane slots is arcuate.

3. The antenna of claim 2, wherein at least one of the first and second ground plane slots is an elliptical arc.

4. The antenna of claim 2, wherein at least one of the first and second ground plane slots is a circular arc.

5. The antenna of claim 4, wherein the centre of the circular arc of the first ground plane slot is at the intersection of the first arm and the second arm when the second plane is projected into the first plane.

6. The antenna of claim 4, wherein the bisector of the arc angle of the first ground plane slot bisects the angle between the first and second arms when the second plane is projected into the first plane.

7. The antenna of claim 1, wherein the radiator is circular.

8. The antenna of claim 7, wherein the centre of the radiator is at the intersection of the first arm and the second arm when the third plane is projected into the first plane.

9. An antenna comprising:

a feedline having a path in a first plane, the path having a first arm and a second arm perpendicular to the first arm;

a ground plane provided in a second plane spaced apart from, and parallel to, the first plane, the ground plane having a ground plane slot therein with a path in the second plane, wherein the path of the ground plane slot intersects the path of the feedline at a first position on the first arm and a second position on the second arm when the second plane is projected into the first plane;

a radiator separated from the feedline by the ground plane, the radiator being provided in a third plane spaced apart from, and parallel to, the second plane, wherein the radiator is circular and has a first radiator slot and a second radiator slot, the first and second radiator slots being on a diameter of the radiator on opposite sides of the centre and at the edge of the radiator.

10. The antenna of claim 1, wherein the radiator comprises:

an inner section formed of an inner portion of the radiator; and an outer section formed of an outer ring of the radiator.

11. The antenna of claim 1, wherein each of the first and second ground plane slots is arcuate.

12. The antenna of claim 11, wherein each of the first and second ground plane slots is an elliptical arc.

13. The antenna of claim 11, wherein each of the first and second ground plane slots is a circular arc.

14. The antenna of claim 13, wherein the circular arcs of the first and second ground plane slots have the same centre and the centre is at the intersection of the first arm and the second arm when the second plane is projected into the first plane.

15. The antenna of claim 13, wherein the bisector of the arc angle of the first ground plane slot is also a bisector of the arc angle of the second ground plane slot and bisects the angle between the first and second arms when the second plane is projected into the first plane.

16. The antenna of claim 10, wherein the outer section of the radiator has a first outer radiator slot and a second outer radiator slot, the first and second outer radiator slots lying on a diameter of the radiator on opposite sides of the centre of the radiator and at an edge of the outer section.

17. The antenna of claim 10, wherein:

the inner section of the radiator has a first inner radiator slot and a second inner radiator slot, the first and second inner radiator slots lying on a diameter of the radiator on opposite sides of the centre of the radiator and at the edge of the inner section; and the outer section of the radiator has a first outer radiator slot and a second outer radiator slot, the first and second outer radiator slots lying on the diameter of the radiator on opposite sides of the centre of the radiator and at an edge of the outer section.

18. An antenna comprising:

a feedline having a path in a first plane, the path having a first arm and a second arm perpendicular to the first arm;

a ground plane provided in a second plane spaced apart from, and parallel to, the first plane, the ground plane having a ground plane slot therein with a path in the second plane, wherein the path of the ground plane slot intersects the path of the feedline at a first position on the first arm and a second position on the second arm when the second plane is projected into the first plane;

a radiator separated from the feedline by the ground plane, the radiator being provided in a third plane spaced apart from, and parallel to, the second plane, and wherein:

the ground plane has a first ground plane slot and a second ground plane slot therein, each ground plane slot having a path that is a circular arc in the second plane;

the path of the first ground plane slot intersects the path of the feedline at a first position on the first arm and a second position on the second arm when the second plane is projected into the first plane;

the path of the second ground plane slot intersects the path of the feedline at a third position on the first arm and a fourth position on the second arm when the second plane is projected into the first plane;

the circular arcs of the first and second ground plane slots have the same centre and the centre is at the intersection of the first arm and the second arm when the second plane is projected into the first plane;

the radiator is circular and comprises:

a circular inner section; and an outer section formed of an outer circular ring electrically separated from the inner section by a circular separating ring;

and wherein:

the inner section of the radiator has a first inner radiator slot and a second inner radiator slot, the first and second inner radiator slots lying on a diameter of the radiator on opposite sides of the centre and at the edge of the inner section.

19. The antenna of claim 18, wherein the bisector of the arc angle of the first ground plane slot is also a bisector of the arc angle of the second ground plane slot and bisects the angle between the first and second arms when the second plane is projected into the first plane.

20. A device comprising an antenna according to claim 1, wherein the radiator is printed or plated onto the case of the device.

* * * * *